US005473865A

United States Patent [19]

Tanaka et al.

[11] Patent Number: 5,473,865

[45] Date of Patent: Dec. 12, 1995

[54] AUTOMATIC BAGGING APPARATUS

[75] Inventors: Yoshinori Tanaka, Nagoya; Shozo Ogata, Aichi, both of Japan

[73] Assignee: Hoshizaki Denki Kabushiki Kaisha, Toyoake, Japan

[21] Appl. No.: 103,995

[22] Filed: Aug. 10, 1993

[30] Foreign Application Priority Data

Aug. 10, 1992 [JP] Japan ..... 4-212804

[51] Int. Cl.[6] ..... B65B 37/18; B65B 45/00; B65B 57/00; B65B 57/12

[52] U.S. Cl. ..... 53/502; 53/77; 53/506; 53/508

[58] Field of Search ..... 53/502, 506, 505, 53/77, 507, 508, 494, 431

[56] References Cited

U.S. PATENT DOCUMENTS 3,731,454 5/1973 Crabb ..... 52/506 X
3,864,894 2/1975 Sheetz et al. ..... 53/506
4,177,621 12/1979 Powell, Jr. ..... 53/506 X
5,109,651 5/1992 Stuart ..... 53/502
5,142,846 9/1992 Alameda ..... 53/506

*Primary Examiner*—James F. Coan
*Attorney, Agent, or Firm*—Nikaido, Marmelstein, Murray & Oram

[57] ABSTRACT

In an automatic bagging apparatus, a foremost bag F of stacked bags stored in a bag storage mechanism 10 is fed by a bag feeding mechanism 20 and supported by a bag support mechanism 30. The supported bag is supplied with a predetermined amount of ice cubes, and the bagged ice cubes are accumulated in an ice storage bin. The bag feeding mechanism 20 is provided with a clamping mechanism 20*a* for grasping the bag at its two positions and detection switches SW4, SW5 for detecting the fact that the bag F has been correctly fed by the clamping mechanism 20*a*. When it has been detected by the detection switches SW4, SW5 that the bag F could not be correctly fed or that there is not any bag in the bag storage mechanism 10, the feeding operation of the bag is repeated predetermined times. If the bag F could not be correctly fed, the feeding operation of the bag is stopped, and the remained ice cubes are melted by water sprinkled from a watering pipe to be drained.

4 Claims, 19 Drawing Sheets

Fig.6
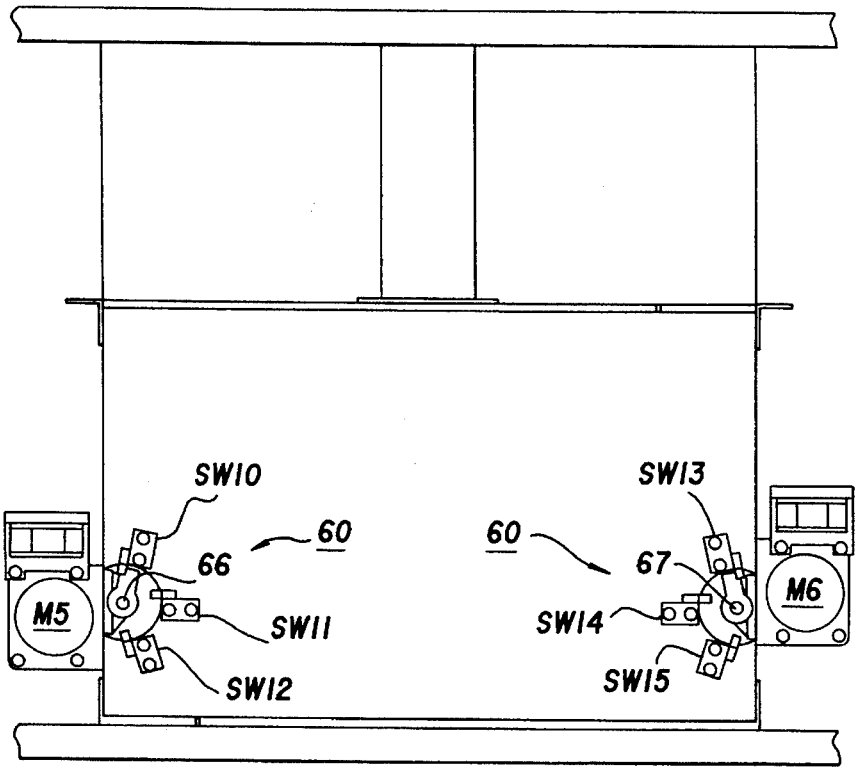
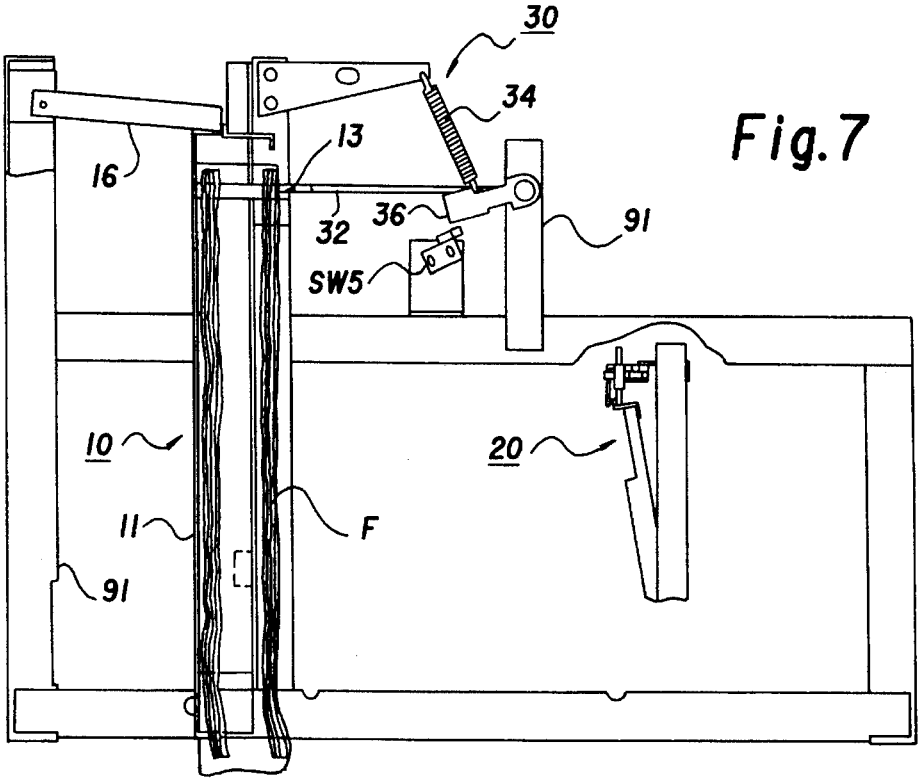
Fig.7

AUTOMATIC BAGGING APPARATUS

BACKGROUND OF THE INVENTION

1. Field of the Invention

The present invention relates to an automatic bagging apparatus for automatically bagging a predetermined amount of articles such as ice cubes.

2. Discussion of the Prior Art

As disclosed in U.S. Pat. No. 5,109,651, a conventional bagging apparatus of this kind comprises a bag storage mechanism disposed between an ice making machine and an ice storage bin to store a number of stacked bags, a bag feeding mechanism arranged to feed a foremost bag of the stacked bags from the bag storage mechanism to a predetermined position, a bag support mechanism arranged to support the foremost bag fed by the feeding mechanism for deploying an upper opening of the bag, a storage tank arranged below the ice making machine to store ice cubes supplied from the ice making machine, an ice delivery mechanism arranged to successively deliver ice cubes from the storage tank into the supported bag, a weighing mechanism arranged below the support mechanism to weigh an amount of ice cubes supplied into the supported bag, a sealing mechanism for sealing the upper opening of the bag, and an electric control apparatus for controlling each operation of the foregoing mechanisms. The electric control apparatus is designed to repeatedly operate the bag feeding mechanism, the ice delivery mechanism and the sealing mechanism in sequence for successively bagging a predetermined amount of ice cubes and accumulating the bagged ice cubes in the ice storage bin.

In the conventional bagging apparatus, the electric control apparatus will continue to conduct the sequence operation of the foregoing mechanisms even if the bag feeding mechanism failed to feed the foremost bag to the predetermined position. As a result, the ice cubes will wastefully drop from the ice delivery mechanism without being bagged.

SUMMARY OF THE INVENTION

It is, therefore, a primary objection of the present invention to provide an automatic bagging apparatus capable of avoiding dropping of the articles such as ice cubes from the delivery mechanism even if the bag feeding mechanism failed to feed the foremost bag to the predetermined position.

According to the present invention, the object is accomplished by providing an automatic bagging apparatus for successively bagging a predetermined amount of articles, comprising a bag storage mechanism arranged to store a number of stacked bags the upper openings of which are positioned upwardly, a bag feeding-support mechanism arranged to feed a foremost bag of the stacked bags to a predetermined position and to support the foremost bag for deploying the upper opening of the bag, a delivery mechanism arranged within a storage tank to deliver articles therefrom into the deployed bag, a weighing mechanism arranged to measure an amount of articles supplied into the deployed bag, a sealing mechanism arranged to seal the upper opening of the bag supplied with a predetermined amount of the articles, and an electric control apparatus for repeatedly controlling a sequence operation comprised of the steps of operating the bag feeding-support mechanism for feeding the foremost bag to the predetermined position, operating the delivery mechanism for supplying the articles from the storage tank into the deployed bag until a predetermined amount of the articles is measured by the weighing mechansim and operating the sealing mechanism for sealing the upper opening of the bag, wherein the bag feeding-support mechanism is provided with detection means for detecting the fact that the bag has been correctly fed to the predetermined position, and wherein the electric control apparatus comprises means for stopping the sequence operation of the foregoing mechanisms when it has been detected by the detection means that the bag could not be correctly fed to the predetermined position.

According to an aspect of the present invention, there is provided an automatic bagging apparatus for successively bagging a predetermined amount of articles, comprising a bag storage mechanism arranged to store a number of stacked bags the upper openings of which are positioned upwardly, a bag feeding-support mechanism arranged to feed a foremost bag of the stacked bags to a predetermined position and to support the foremost bag for deploying the upper opening of the bag, a delivery mechanism arranged within a storage tank to deliver articles therefrom into the deployed bag, a weighing mechanism arranged to measure an amount of articles supplied into the deployed bag, a sealing mechanism arranged to seal the upper opening of the bag supplied with a predetermined amount of the articles, and an electric control apparatus for repeatedly controlling a sequence operation comprised of the steps of operating the bag feeding-support mechanism for feeding the foremost bag to the predetermined position, operating the delivery mechanism for supplying the articles from the storage tank into the deployed bag until a predetermined amount of the articles is measured by the weighing mechansim and operating the sealing mechanism for sealing the upper opening of the bag, wherein the bag feeding-support mechanism is provided with detection means for detecting the fact that the bag has been correctly fed to the predetermined position, and wherein the electric control apparatus comprises means for repeatedly operating the bag feeding-support mechanism when it has been detected by the detection means that the bag could not be correctly fed to the predetermined position and means for stopping the sequence operation of the foregoing mechanisms when it has been detected by the detection means that the bag could not be correctly fed to the predetermined position even when the bag feeding-support mechanism was repeatedly operated more than predetermined times.

In the automatic bagging apparatus described above, it is preferable that the bag feeding-support mechanism is provided with a release mechanism for releasing the bag from the bag feeding-support mechanism, wherein the electric control apparatus comprises means for controlling the release mechanism to release the bag from the bag feeding-support mechanism when it has been detected by the detection means that the bag could not be correctly fed to the predetermined position.

According to another aspect of the present invention, there is provided an automatic bagging apparatus for successively bagging a predetermined amount of articles, comprising a bag storage mechanism arranged to store a number of stacked bags the upper openings of which are positioned upwardly, a bag feeding-support mechanism arranged to feed a foremost bag of the stacked bags to a predetermined position and to support the foremost bag for deploying the upper opening of the bag, a delivery mechanism arranged within a storage tank to deliver articles therefrom into the deployed bag, a weighing mechanism arranged to measure an amount of articles supplied into the deployed bag, a sealing mechanism arranged to seal the upper opening of the bag supplied with a predetermined amount of the articles, and an electric control apparatus for repeatedly controlling a sequence operation comprised of the steps of operating the bag feeding-support mechanism for feeding the foremost bag to the predetermined position, operating the delivery mechanism for supplying the articles from the storage tank into the deployed bag until a predetermined amount of the articles is measured by the weighing mechansim and operating the sealing mechanism for sealing the upper opening of the bag, wherein the bag feeding-support mechanism comprises a clamping mechanism for grasping the foremost bag at its two positions, a movable mechanism cooperable with the clamping mechanism for feeding the foremost bag grasped by the clamping mechanism, a pair of support rods for supporting the foremost bag fed by the movable mechanism and a pair of detection means for detecting the fact that the foremost bag is being correctly grasped by the clamping mechanism at its two positions, wherein the electric control apparatus comprises an indication device, first control means for controlling the indication device to indicate an error in operation of the bag feeding-support mechanism when one of the detection means has detected the fact that the bag is being grasped by the clamping mechanism at its one position while the other detection means has detected the fact that the bag could not be grasped by the clamping mechanism at its other position, and second control means for activating the indication device to indicate lack of the bag when both the detection means have detected the fact that the bag could not be correctly grasped by the clamping mechanism at its two positions.

According to a further aspect of the present invention, there is provided an automatic bagging apparatus for successively bagging a predetermined amount of ice cubes, comprising a bag storage mechanism arranged to store a number of stacked bags the upper openings of which are positioned upwardly, a bag feeding-support mechanism arranged to feed a foremost bag of the stacked bags to a predetermined position and to support the foremost bag for deploying the upper opening of the bag, a storage tank arranged to store an amount of ice cubes, a delivery mechanism arranged within the storage tank to deliver the ice cubes therefrom into the deployed bag, a weighing mechanism arranged to measure an amount of the ice cubes supplied into the deployed bag, a sealing mechanism arranged to seal the upper opening of the bag supplied with a predetermined amount of the ice cubes, and an electric control apparatus for repeatedly controlling a sequence operation comprised of the steps of operating the bag feeding-support mechanism for feeding the foremost bag to the predetermined position, operating the delivery mechanism for supplying the ice cubes from the storage tank into the deployed bag until a predetermined amount of the ice cubes is measured by the weighing mechanism and operating the sealing mechanism for sealing the upper opening of the bag, wherein the bag feeding-support mechanism is provided with detection means for detecting the Fact that the foremost bag has been correctly fed to the predetermined position, wherein a watering pipe is arranged above the storage tank, and wherein the electric control apparatus comprises means for stopping the sequence operation of the foregoing mechanisms and supplying water into the watering pipe when it has been detected by the detection means that the bag could not be correctly fed to the predetermined position.

BRIEF DESCRIPTION OF THE DRAWINGS

Other objects, features and advantages of the present invention will be readily appreciated from the following detailed description of a preferred embodiment thereof when tanken together with the accompanying drawings, in which:

FIG. 6 is a rear view of the bagging apparatus shown in FIG. 4;

FIG. 7 is a sectional side view of a bag storage mechanism and a bag support mechanism;

DESCRIPTION OF THE PREFERRED EMBODIMENT

Figure 1:
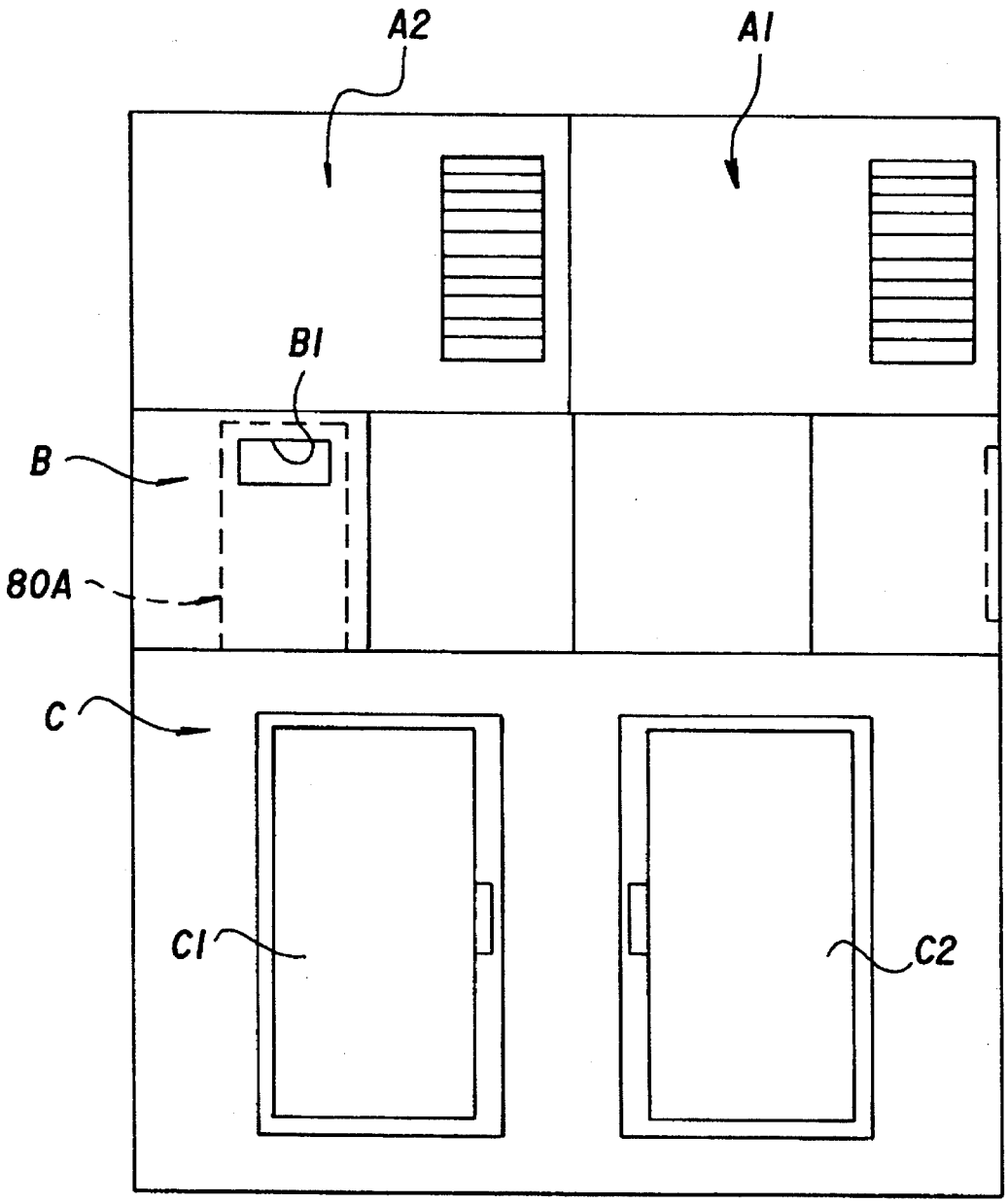
FIG. 1 is a front view of an embodiment of an ice bagging apparatus according to the present invention.

Hereinafter, a preferred embodiment of the present invention will be described with reference to the drawings. In FIG. 1 there is illustrated a front view of an ice making-bagging apparatus in accordance with the present invention. The ice making-bagging apparatus includes an ice bagging apparatus B disposed between a pair of ice making machines A1, A2 and a freezing storage bin C provided at its front with doors C1, C2. As disclosed, for example, in U.S. Pat. No. 4,791,792, the ice making machines A1, A2 each are constructed to automatically produce ice cubes of a predetermined shape at its ice making cycle of operation and release the ice cubes therefrom at its defrost cycle of operation to supply them to the bagging apparatus B.

Figure 2:
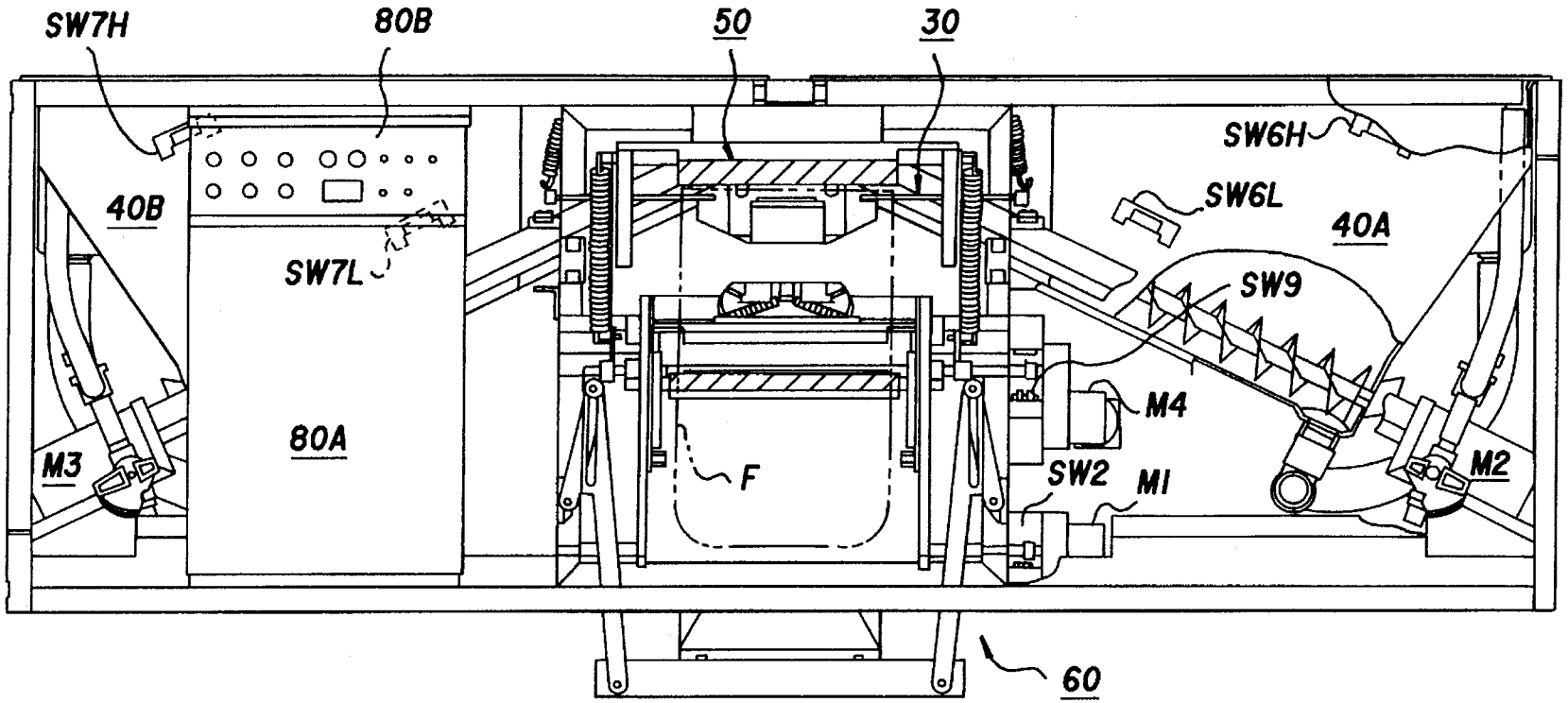
FIG. 2 is a partly broken front view of the bagging apparatus.

As shown in FIGS. 2 to 6, the ice bagging apparatus B comprises a bag storage mechanism 10 arranged at a front central portion of the bagging apparatus B to store a number of stacked bags therein, a bag feeding mechanism 20 arranged at the back side of bag storage mechanism 10 to feed a foremost bag F of the stacked bags to a predetermined position, a bag support mechanism 30 arranged between the bag storage mechanism 10 and the bag feeding mechanism 20 to cooperate with the bag feeding mechanism 20 for depolying the foremost bag F as shown by imaginary lines in FIG. 2 and supporting it thereon, a pair of ice delivery mechanisms 40A, 40B arranged at the opposite sides of the bag support mechanism 30 to store ice cubes supplied from the ice making machines A1, A2 and deliver the ice cubes into the deployed bag F therefrom, a sealing mechanism 50 arranged to heat seal an upper opening of the bag F supplied with a predetermined amount of ice cubes, a bag dropping mechanism 60 arranged below the bag support mechanism 30 to drop the sealed bag F of ice cubes into the storage bin C, and a weighing mechanism integrally assembled with the bag dropping mechanism 60 to measure the amount of ice cubes supplied into the bag F.

Figure 4:
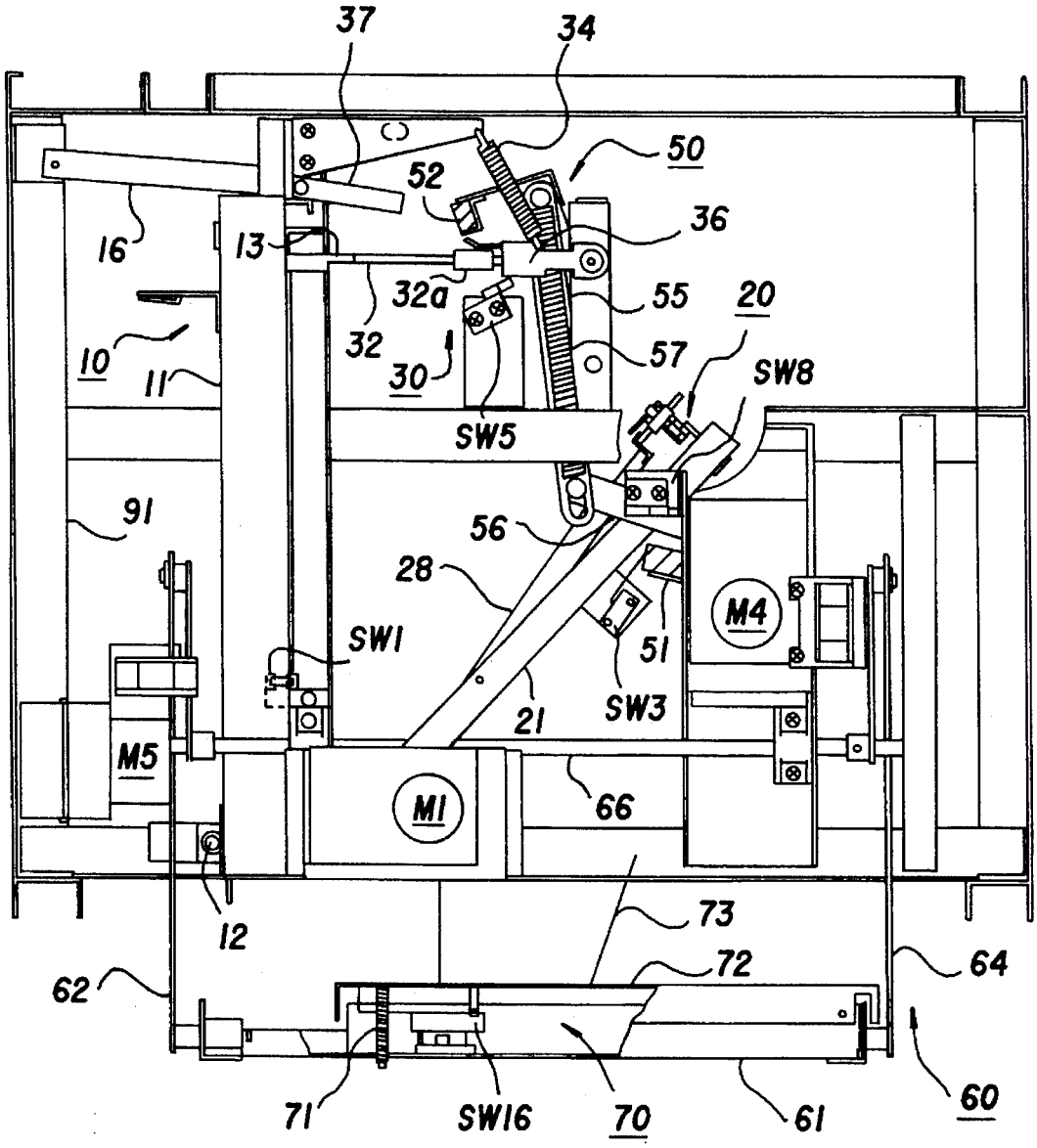
FIG. 4 is a partly broken side view of the bagging apparatus.
Figure 5:
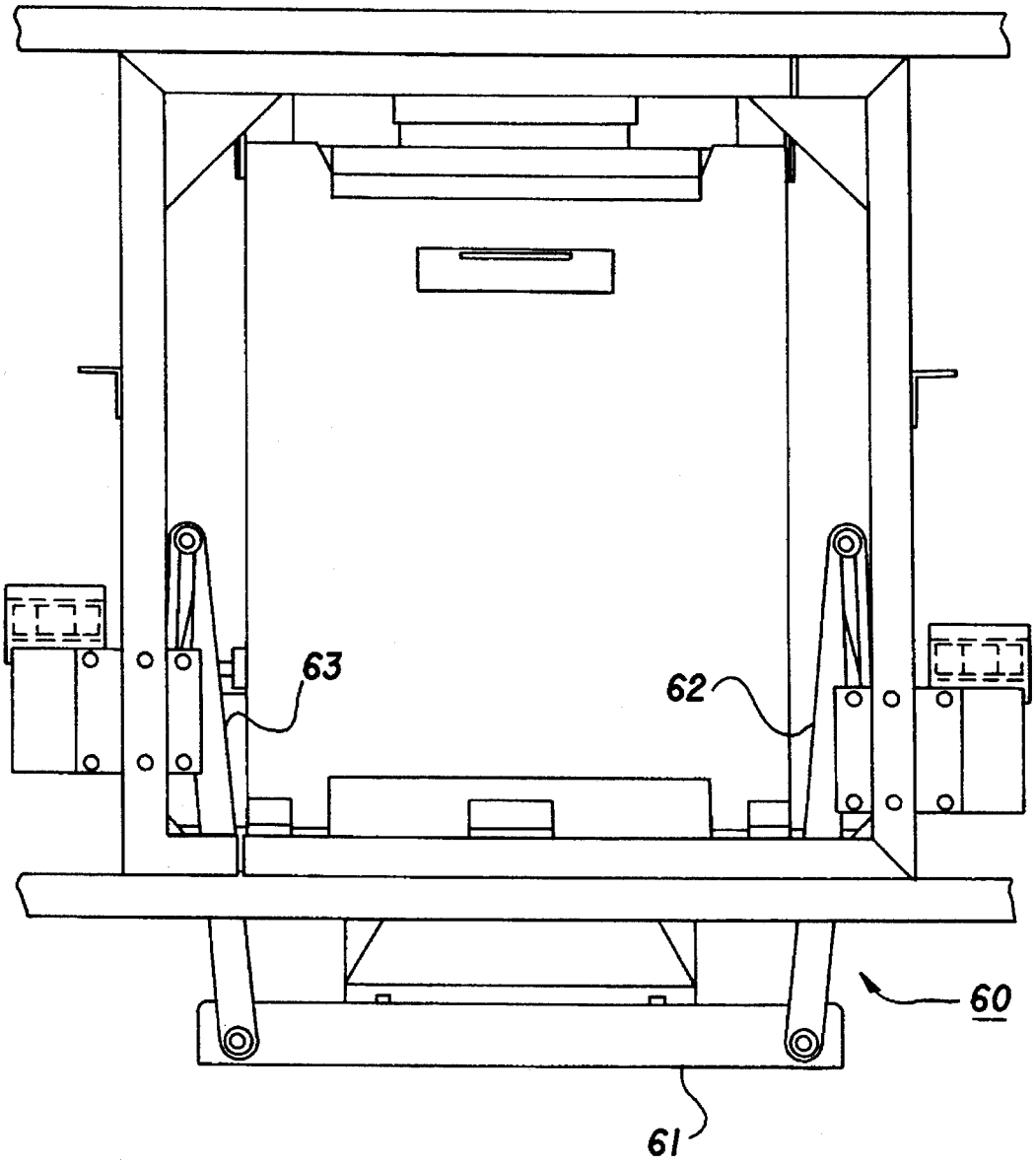
FIG. 5 is a front view of the bagging apparatus shown in FIG. 4.
Figure 8:
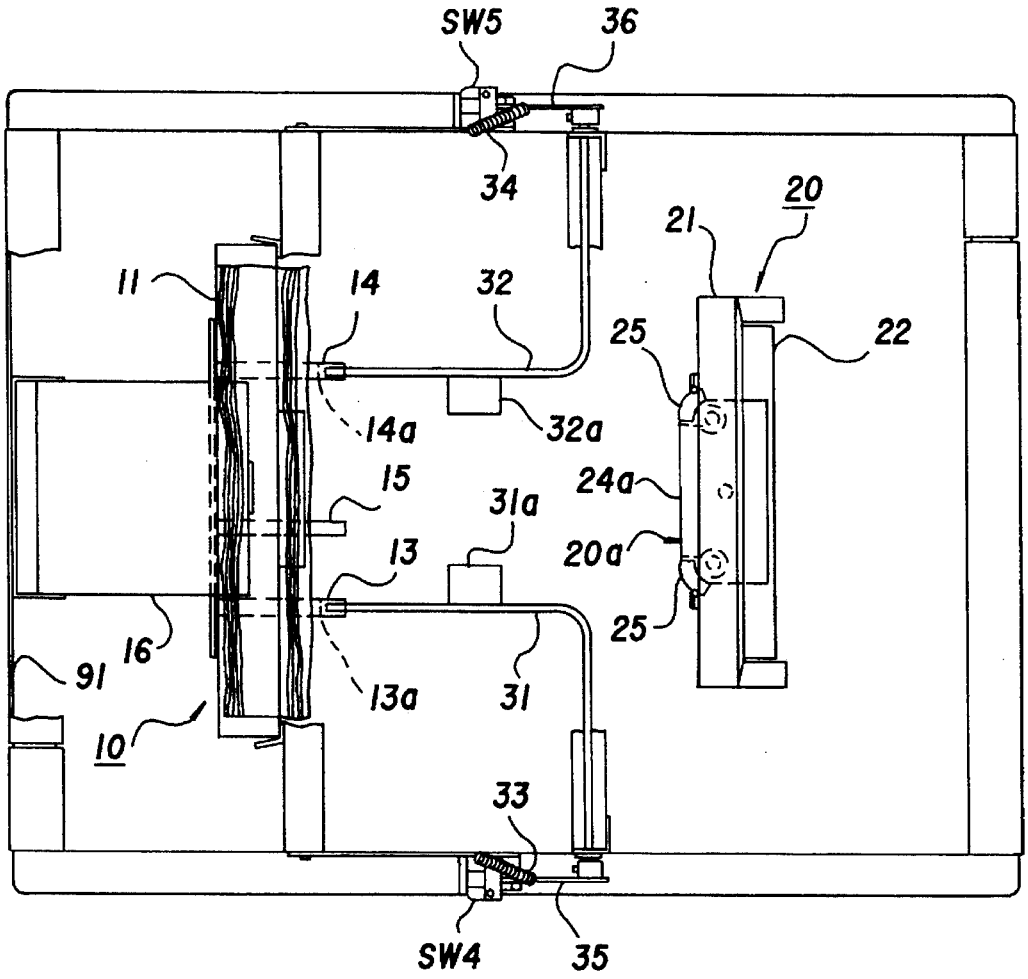
FIG. 8 is a plan view of the bag storage mechanism and the bag support mechanism shown in FIG. 7.
Figures 9A, 9B:
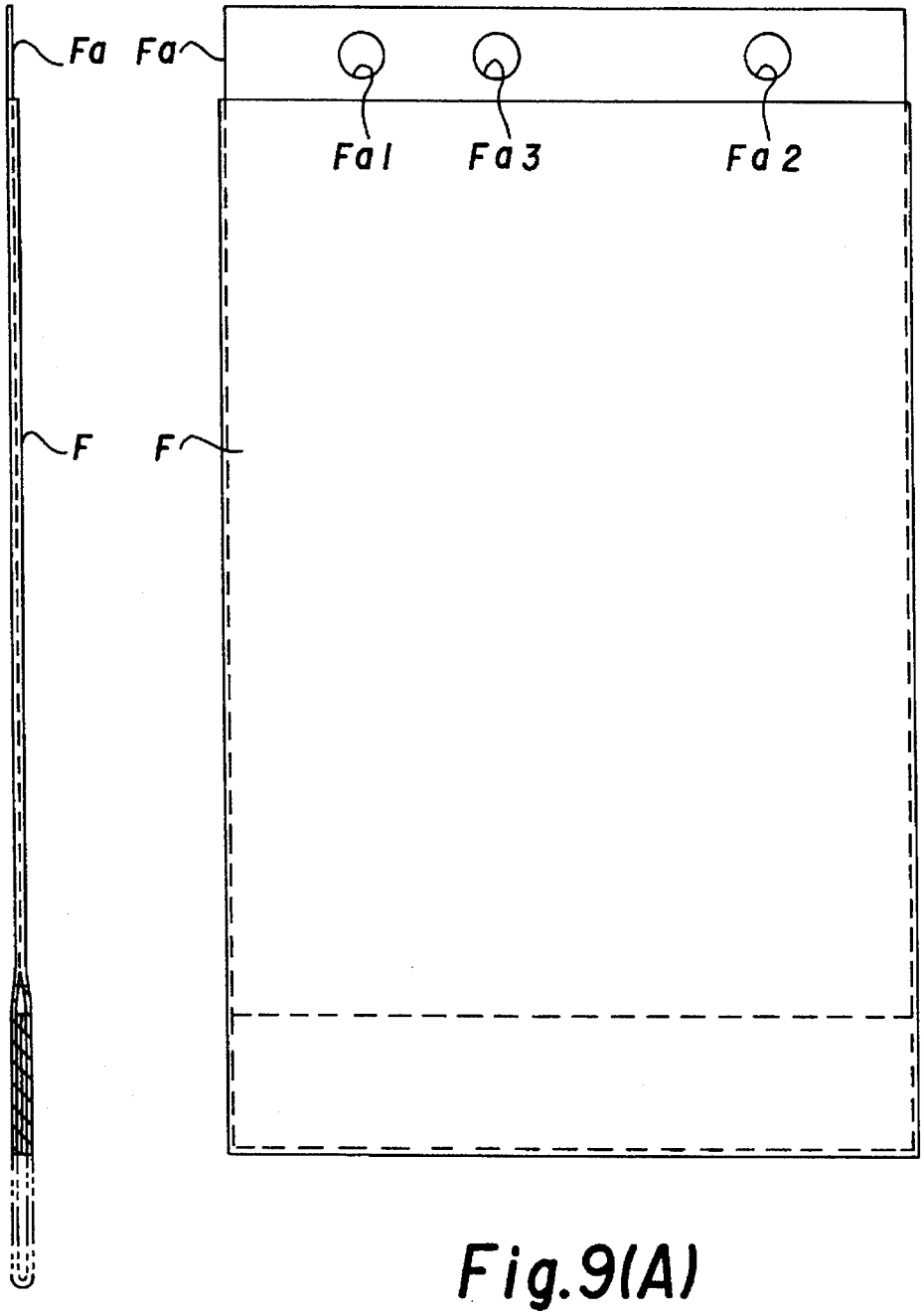
FIG. 9(A) is a front view of a bag stacked in the bag storage mechanism.
FIG. 9(B) is a side view of the bag.

As shown in FIGS. 4, 7 and 8, the bag storage mechanism 10 includes a cassette 11 in the form of a rectangular box which is opened backward and downward to store a number of stacked bags F. The cassette 11 is tiltably mounted on a frame 91 of the bagging apparatus by means of a shaft 12 secured to its lower end. The cassette 11 is provided at its upper end portion with a pair of parallel hollow support pins 13, 14 for supporting the stacked bags F and a positioning pin 15 for preventing an error in support of the stacked bags. The hollow support pins 13, 14 are formed at their bottom sides with axial slits 13*a*, 14*a*. In operation of the bagging apparatus, the cassette 11 is positioned in a vertical direction by means of a fixing plate 16 so that the stacked bags are located to be taken out rearwardly. When the cassette 11 is tilted forward by release of the fixing plate 16, the stacked bags F can be supported on the support pins 13–15 of cassette 11. A detection switch SW1 is mounted on the frame 91 to be turned on when the cassette 11 is positioned in the vertical direction and to be turned off when the cassette 11 is tilted forward. The stacked bags F are made of transparent synthetic resin meltable by heat. The stacked bags F each are folded upward at its bottom portion as shown in FIGS. 9(A) and (B) to be expanded downward when supplied with ice cubes. Each of the bags has an attachment portion Fa formed with mounting holes Fa1, Fa2, Fa3 for engagement with the support pins 13–15 of cassette 11.

Figure 3:
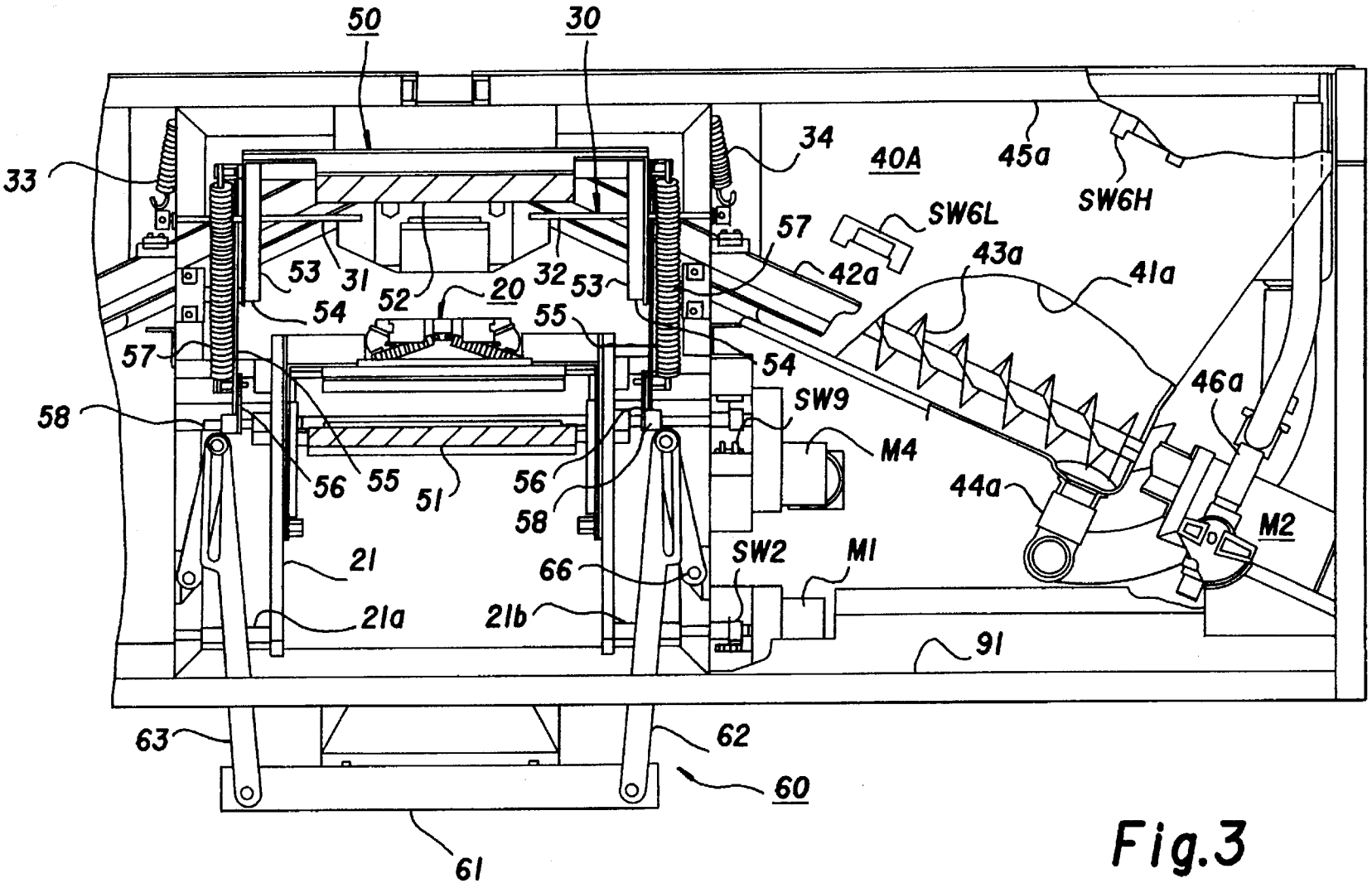
FIG. 3 is an enlarged view of a portion of the bagging apparatus shown in FIG. 2.

As shown in FIGS. 3, 4, 8 and 10–12, the bag feeding mechanism 20 includes an arch-shaped main arm 21 tiltably mounted on the frame 91 by means of a pair of shafts 21*a*, 21*b* secured to its lower end portions. The main arm 21 is tilted by operation of an electric motor M1 with a speed reduction mechanism mounted on the frame 91. As shown in FIG. 3, an optical detection switch SW2 is provided to detect a rotational position of an output shaft of electric motor M1 for detecting a resting position of the main arm 21 shown in FIG. 4. The optical detection switch SW2 is designed to be turned on when the main arm 21 is in its resting position and to be turned off when the main arm 21 is moved from and returned to its resting position. An arch-shaped sub-arm 22 is tiltably assembled with the main arm 21. The sub-arm 22 is formed at its rear portion with a pair of lateral projections 22*a*, 22*b* which are engaged with a pair of leaf springs 23*a*, 23*b* secured to the rear face of main arm 21. When the main arm 21 is tilted in a counterclockwise direction in FIG. 4, the sub-arm 22 is moved by engagement with the leaf springs 23*a*, 23*b* in the same direction. When the main arm 21 is tilted in a clockwise direction in FIG. 4, the sub-arm 22 is moved by engagement with the main arm 21 at its lateral projections in the same direction. In addition, the main arm 21 is provided at its rear portion with a detection switch SW3 which is arranged to be turned on when the main arm 21 has been tilted relative to the sub-arm 22 at more than a predetermined angle.

Figure 10:
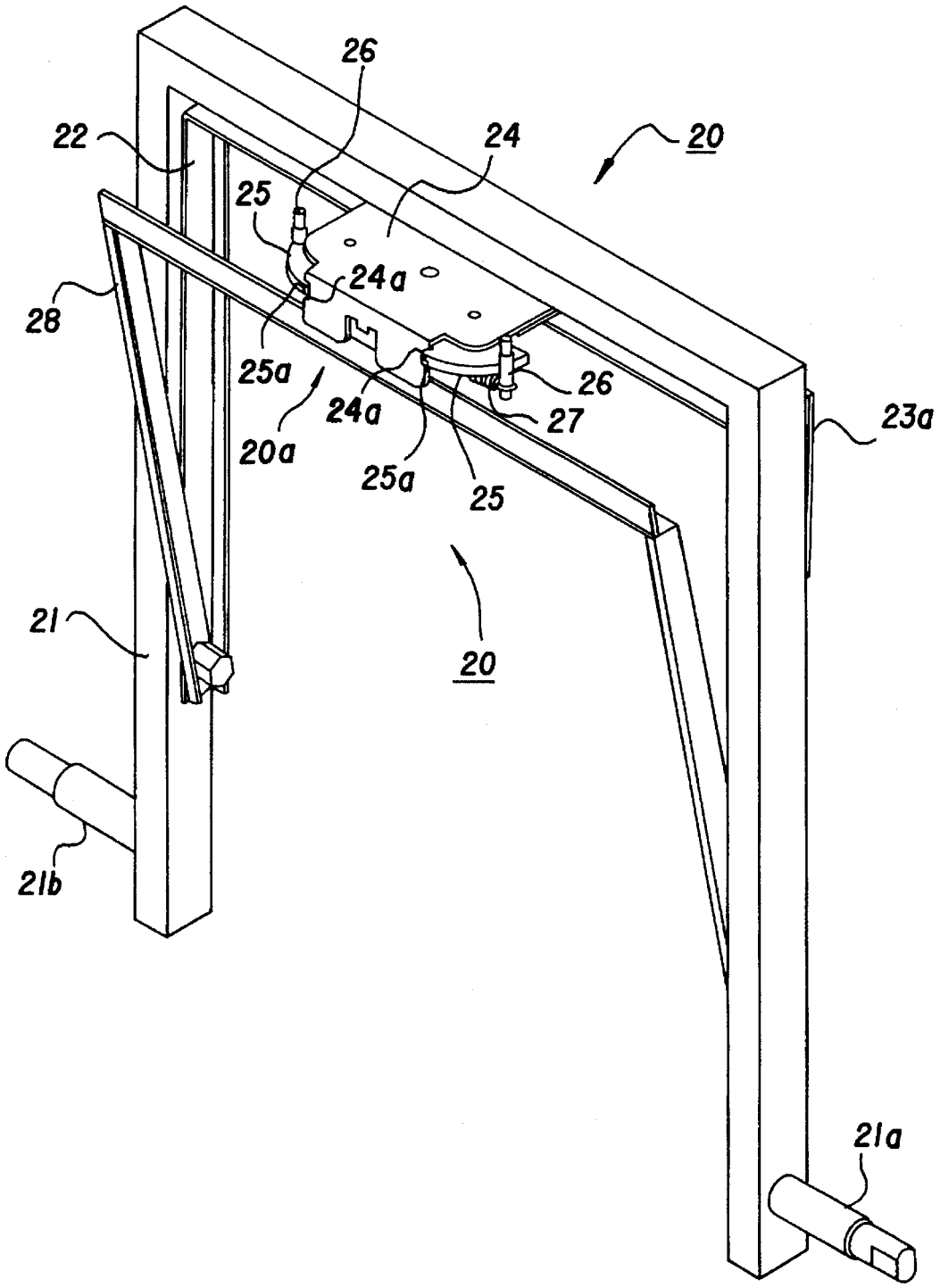
FIG. 10 is a perspective view of a bag feeding mechanism taken from its front side.
Figure 11:
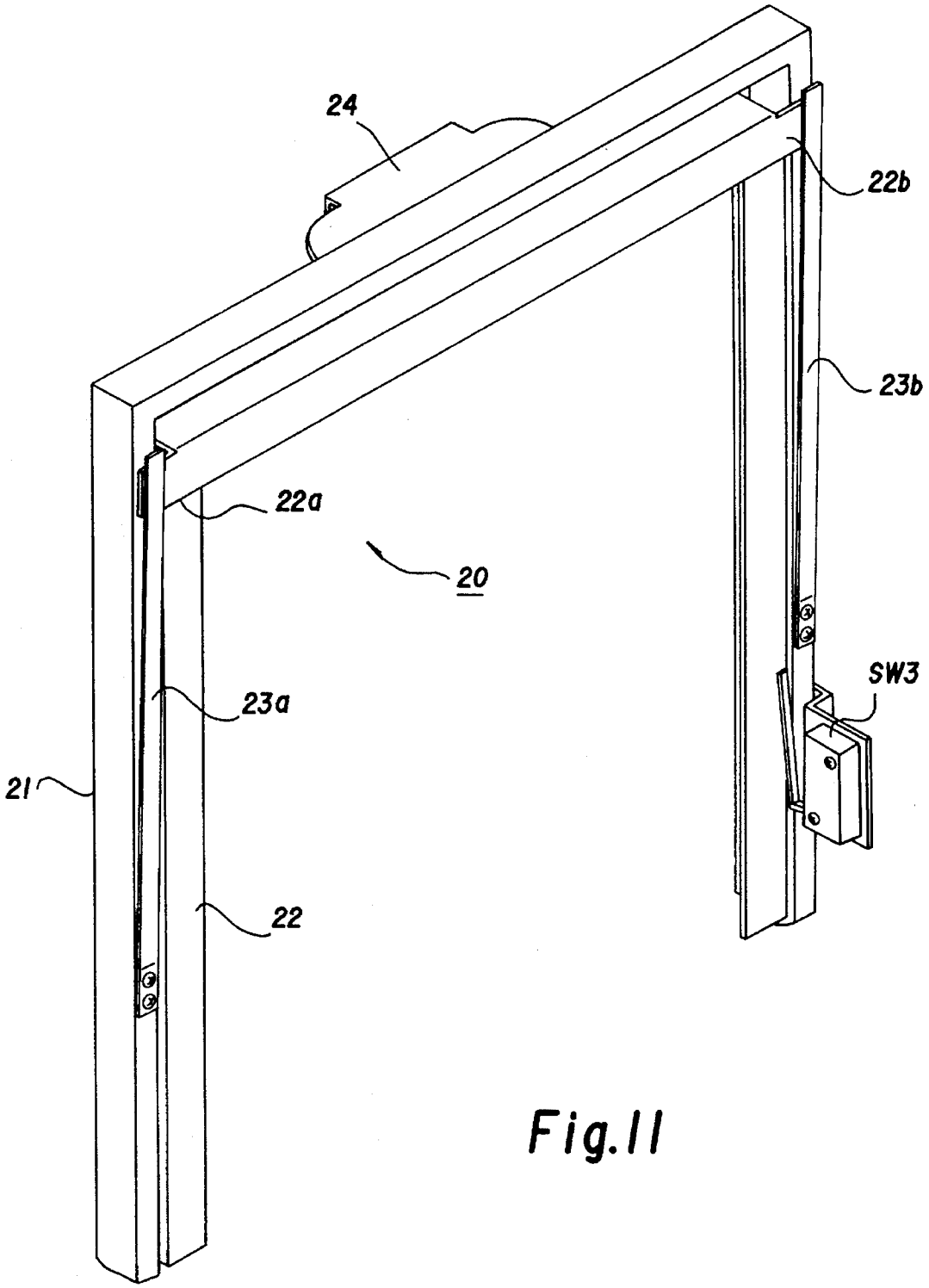
FIG. 11 is a perspective view of the bag feeding mechanism taken from its rear side.

The sub-arm 22 is provided at its upper end with a support plate 24 which is bent downwardly as shown in FIG. 10 and with a pair of swingable levers 25, 25 pivoted thereto. The downwardly bent portion of support plate 24 is recessed at its opposite sides to form a pair of stationary pawls 24*a*, 24*a*. The swingable levers 25, 25 each are formed with a serrated movable pawl 25*a* for engagement with the corresponding stationary pawl 24*a*. A pair of vertical pins 26, 26 are secured to each outer periphery of the swingable levers 25, 25 and engaged with respective springs 27, 27 which are connected at their other ends to a central portion of the support plate 24. The springs 27, 27 act to bias the swingable levers 25, 25 forwardly when the movable pawls 25*a*, 25*a* are engaged with the stationary pawls 24*a*, 24*a* and to bias the swingable levers 25, 25 rearwardly when the movable pawls 25*a*, 25*a* are disengaged from the stationary pawls 24*a*, 24*a*. An arch-shaped release lever 28 is tiltably assembled with the sub-arm 22 in such a manner that an upper end portion of release lever 28 is arranged to be movable between the downwardly bent portion of support plate 24 and the vertical pins 26, 26. In this embodiment, a clamping mechanism 20*a* for grasping the bag at its two positions is composed of the swingable levers 25, vertical pins 26, springs 27 and release levers 28.

As shown in FIGS. 2–4, 7 and 8, the bag support mechanism 30 includes a pair of L-letter shaped support rods 31, 32 rotatably mounted on the frame 91 at their one ends. The support rods 31, 32 are biased clockwisely in FIGS. 4 and 7 by means of springs 33, 34 engaged at their one ends with a support member for the bag storage mechanism 10. Under the load of springs 33, 34, the support rods 31, 32 are engaged at their other ends with-the axial slits 13*a*, 14*a* of support pins 13, 14 of bag storage mechanism 10. The support rods 31, 32 are provided at their parallel portions with stoppers 31*a*, 32*a* which restrict displacement of the attachment portion of the bag F when the bag F has been stretched rightward in FIGS. 4, 7 and 8 by means of the bag feeding mechanism 20. The support rods 31, 32 are further provided at their one ends with light blocking plates 35, 36 for rotation therewith. A pair of optical detection switches SW4, SW5 are mounted on the frame 91 to detect rotation of the light blocking plates 35, 36. The optical detection switches SW4, SW5 are arranged to be turned on when the support rods 31, 32 are retained in their resting positions shown in FIGS. 4, 7 and 8 and to be turned off when the support rods 31, 32 are rotated counterclockwisely in a slight amount to be turned on when the support rods 31, 32 are further rotated counterclockwisely. When the cassette 11 is tilted forwardly for supply of the stacked bags F, a lever 37 shown in FIG. 4 is rotated to move the support rods 31, 32 downward against the load of springs 33, 34. When the cassette 11 is set in its vertical position after supplied with the stacked bags F, the support pins 13, 14 are brought into engagement with the support rods 31, 32 at their axial slits 13*a*, 14*a*.

As shown in FIG. 3, the right-hand ice delivery mechanism 40A includes an ice storage tank 41*a* mounted on the frame 91 to store ice cubes supplied from the right-hand ice making machine A1. An ice delivery chute 42*a* is assembed within the storage tank 41*a* to deliver the stored ice cubes toward a central portion of the bagging apparatus B. An auger 43*a* is rotatably mounted within the delivery chute 42*a* and connected at its lower end to an electric motor M2 to be driven for transporting the ice cubes upward from the bottom of storage tank 41*a*. A drain pipe 44*a* is connected at its upper end to the bottom of storage tank 41*a* to discharge water of ice melted in the storage tank 41*a*. A watering pipe 45*a* is arranged above the storage tank 41*a* to dissolve the ice cubes in the storage tank 41*a* in the occurrence of trouble in the bagging apparatus. The watering pipe 45*a* is supplied with water from an external source of water through a water valve 46*a* operated by an electromagnetic solenoid SLa. The storage tank 41*a* is provided at its lower portion with an optical detection switch SW6L and at its upper portion with an optical detection switch SW6H. The optical detection switch SW6L is normally closed to be turned on when an amount of ice cubes in the storage tank 41*a* becomes more than for one bag. The detection switch SW6H is normally closed to be turned on when the storage tank 41*a* is filled with ice cubes.

The left-hand ice delivery mechanism 40B is constructed symmetrically with the right-hand ice delivery mechanism 40A, which includes an ice storage tank 41*b*, an ice delivery chute 42*b*, an auger 43*b*, a drain pipe 44*b*, a watering pipe 45*b* and a water valve 46*b* (not shown) arranged in the same manner as those in the right-hand ice delivery mechanism 40A. In the following description, the component parts of the right-hand ice delivery mechanism 40A are called with the word "right", while the component parts of the left-hand ice delivery mechanism 40B are called with the word "left". In addition, the left-hand ice delivery mechanism 40B is provided with an electric motor M3 and optical detection switches SW7L, SW7H similar to those in the right-hand ice delivery mechanism 40A.

As shown in FIGS. 3 and 4, the sealing mechanism 50 includes a heater block 51 and a heat seal bar 52. The heater block 51 is fixedly mounted on the frame 91 to be heated by energization of a heater element assembled therein. The heat seal bar 52 is mounted on an arch-shaped support arm 53 which is rotatably mounted on the frame 91 by means of a pair of support shafts 54, 54 secured thereto. The arch-shaped support arm 53 is operatively connected at its opposite ends to a drive shaft 58 by means of a pair of link arms 55, 55, a pair of drive arms 56, 56 and a pair of tension coil springs 57, 57. Thus, the arch-shaped support arm 53 is tilted by rotation of the drive shaft 58 to move the heat seal bar 52 toward and away from the heater block 51. The drive shaft 58 is rotatably mounted on the frame 91 and is driven by an electric motor M4 mounted on the frame 91. A detection switch SW8 is mounted on the frame 91 at a position adjacent the right-hand drive arm 56. The detection switch SW8 is normally turned off to be turned on when the heat seal bar 52 is placed at an upper position. A detection switch SW9 is mounted on the frame 91 at a position adjacent the right end of drive shaft 58. The detection switch SW9 is normally turned off to be turned on when the heat seal bar 52 is placed at a lower position.

As shown in FIGS. 3–6, the bag dropping mechanism 60 includes a rectangular base plate 61 which is supported at its four corners by means of four pairs of link members 62, 63, 64, 65 to be moved upward or downward. The right-hand link members 62, 64 are connected to a drive shaft 66 at their base ends. The drive shaft 66 is rotatably mounted on the frame 91 and is driven by an electric motor M5 with a speed reduction mechanism mounted on the frame 91. The left-hand link members 63, 65 are connected to a drive shaft 67 at their base ends. The drive shaft 67 is rotatably mounted on the frame 91 and is driven by an electric motor M6 with a speed reduction mechanism mounted on the frame 91. (see FIG. 6) As shown in FIG. 6, optical detection switches SW10, SW11. SW12 are mounted on the frame 91 at a position adjacent the right-hand drive shaft 66 to detect rotation of the drive shaft 66. The detection switch SW10 is normally turned off to be turned on when the right end of base plate 61 is placed at an upper position. The detection switch SW11 is normally turned off to be turned on when the right end of base plate 61 is placed at a middle position. The detection switch SW12 is normally turned off to be turned on when the right end of base plate 61 is placed at a lowermost position. Similarly, optical detection switches SW13, SW14, SW15 are mounted on the frame 91 at a position adjacent the left-hand drive shaft 67 to detect vertical movement of the base plate 61.

As shown in FIG. 4, the weighing mechanism 70 includes a weighing plate 72 movably supported on the base plate 61 and biased upwardly by means of coil springs 71. The weighing plate 72 is provided thereon with a receiving plate 73 of U-shaped cross-section for receiving the bag supplied with ice cubes. Arranged below the weighing plate 72 is an optical detection switch SW16 which is mounted on the base plate 61 to measure a weight acting on the weighing plate 72. The detection switch SW16 is normally turned off to be turned on when the weight acting on the weighing plate 72 becomes more than a predetermined value.

Figure 13:
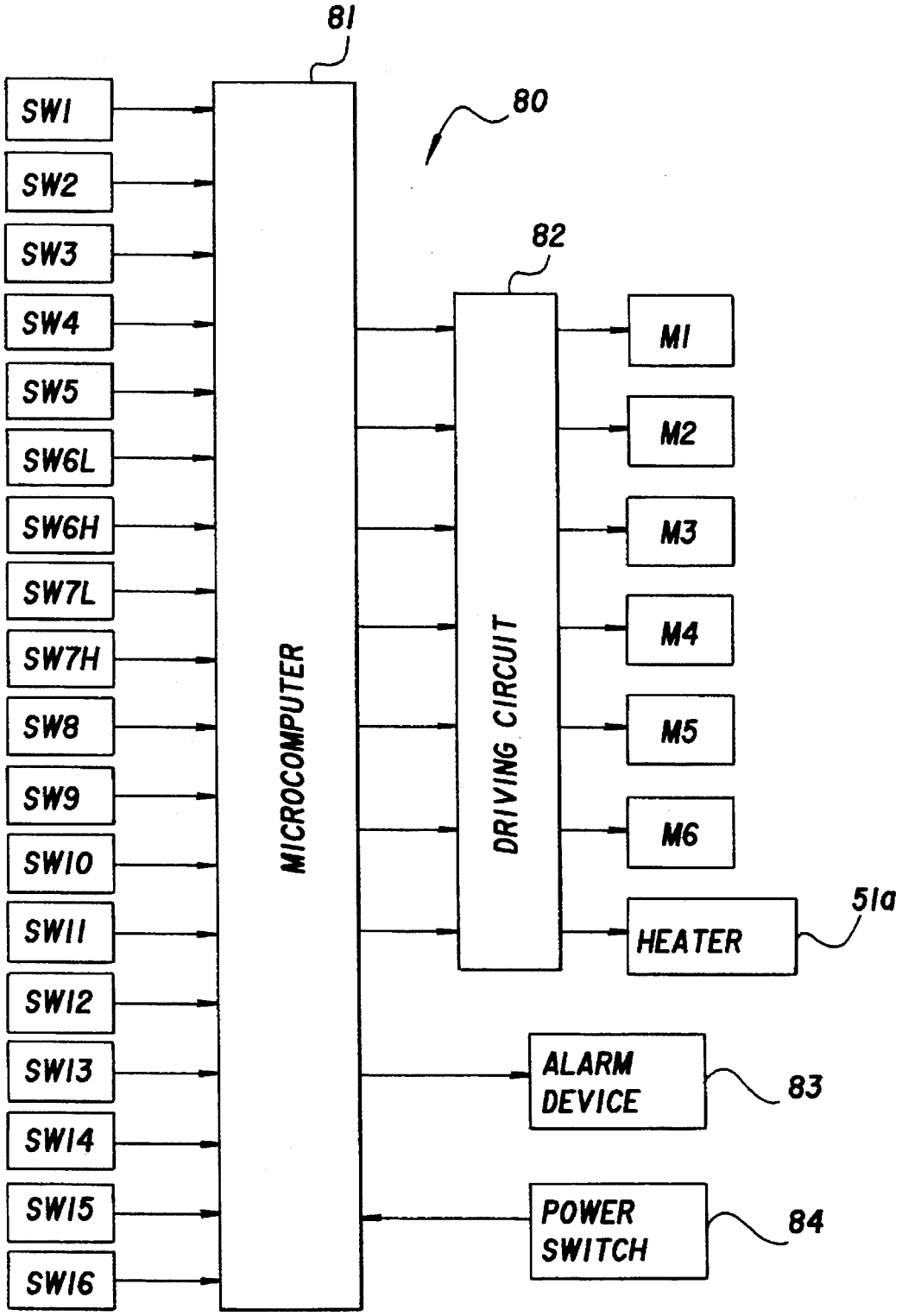
FIG. 13 is a block diagram of an electric control apparatus for the bagging apparatus.
Figure 14:
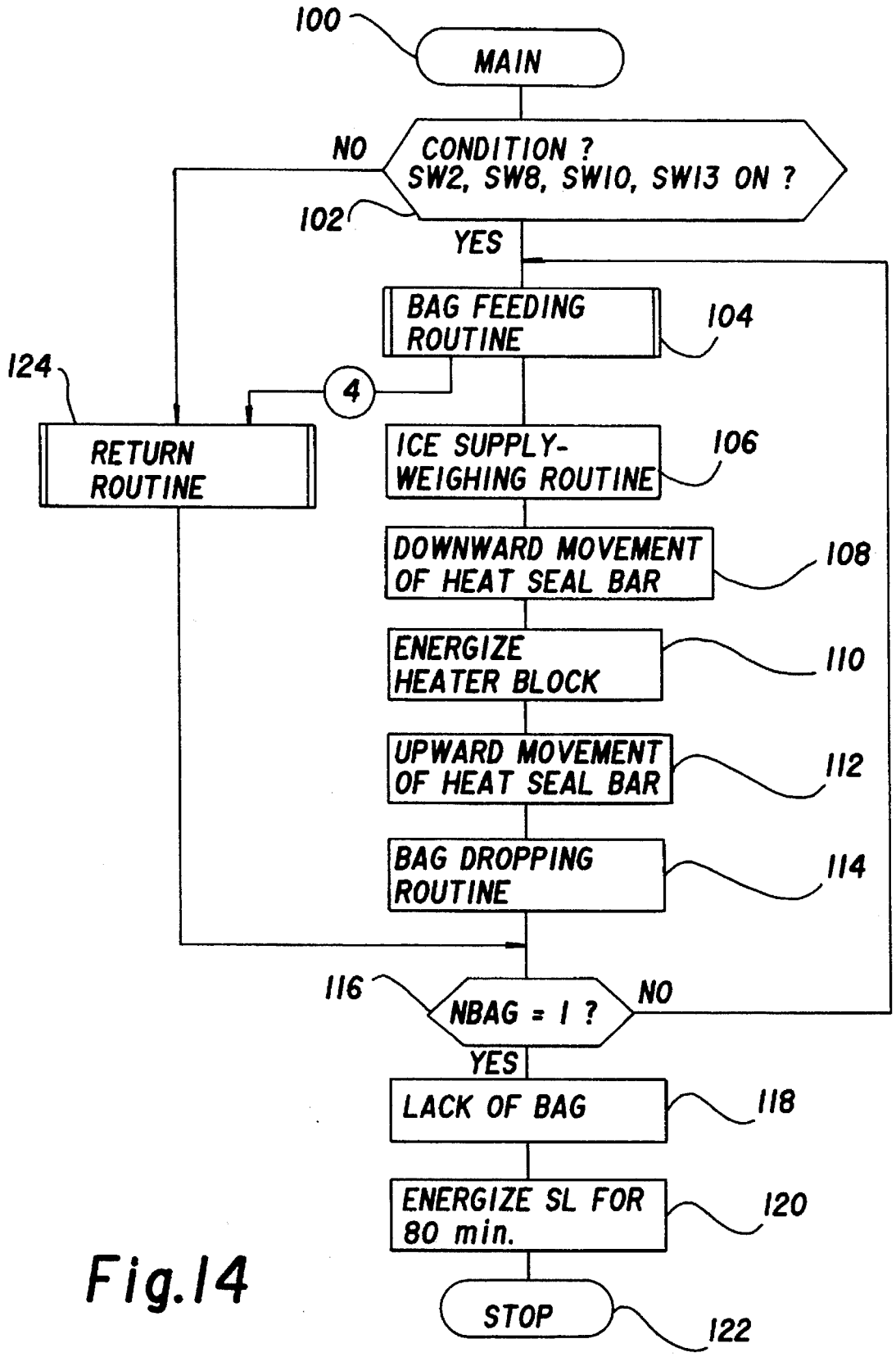
FIG. 14 is a flow chart of a main program executed by a microcomputer shown in FIG. 14.

The ice bagggin apparatus B includes an electric control apparatus 80 for control of the electric motors M1–M6, electromagnetic solenoids SLa, SLb and the heater element 51*a*. As shown in FIG. 13, the electric control apparatus 80 includes a microcomputer 81 (hereiafter simply called a computer) which is connected at one hand to the detection switches SW1–SW16 and at the other hand to a driving circuit 82, an indication device 83 and a power source switch 84. The computer 81 and driving circuit 82 are housed in a control box 80A shown in FIGS. 1 and 2. When the power source switch 84 is closed, the computer 81 is activated to initiate execution of control programs shown by flow charts in FIGS. 14–20. The driving circuit 82 is activated under control of the computer 81 to energize the electric motors M1–M6 and the heater element 51*a*. The indication device 83 and power source switch 84 are mounted on an operation panel 80B which opens toward the exterior through a window formed in the front cover of bagging apparatus B. The indication device 83 is activated under control of the computer 81 to inform the user of trouble in the bagging apparatus, replenishment of fresh bags or the like.

Figure 20A:
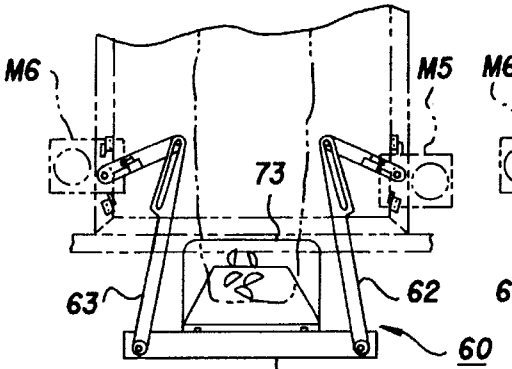
FIG. 20 (A)–(E) illustrates mode of operation of a bag dropping mechanism.
Figure 20B:
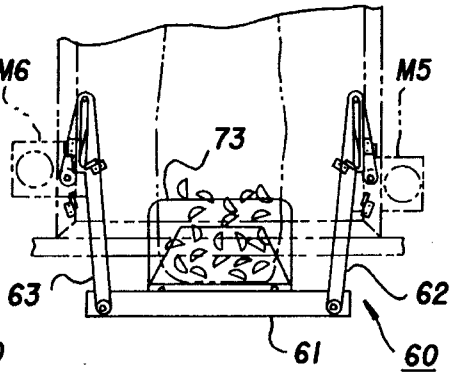
Figure 20C:
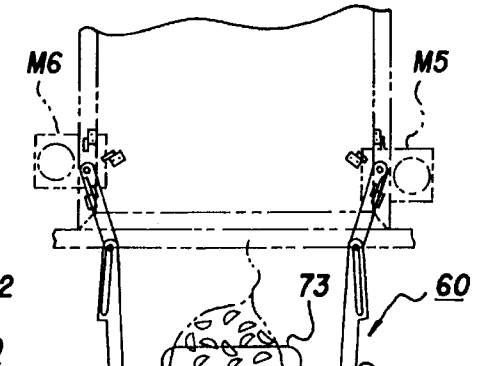

Hereinafter, operation of the bagging apparatus will be described in detail. Assuming that the power source switch 84 has been closed, the computer 81 initiates execution of a main program at step 100 of FIG. 14. At step 102, the computer 81 determines whether the detection switches SW2, SW8, SW10 and SW13 are turned on or not. In this instance, the detection switch SW2 is turned on when the main arm 21 of bag feeding mechanism 20 is placed at its resting position as shown in FIG. 4, the detection switch SW 8 is turned on when the heat seal bar 52 of sealing mechanism 50 is placed at the upper position as shown in FIG. 4, the detection switches SW10, SW13 are turned on when the base plate 61 of bag dropping mechanism 60 is placed at the upper position as shown in FIG. 20(B). If the answer at step 102 is "Yes", the computer 81 executes processing at step 104–116. If either one of the detection switches SW2, SW8, SW10, SW13 is turned off, the computer 81 determines a "No" answer at step 102 and causes the program to proceed to step 124 for execution of a return routine shown in FIG. 17.

Figure 17:
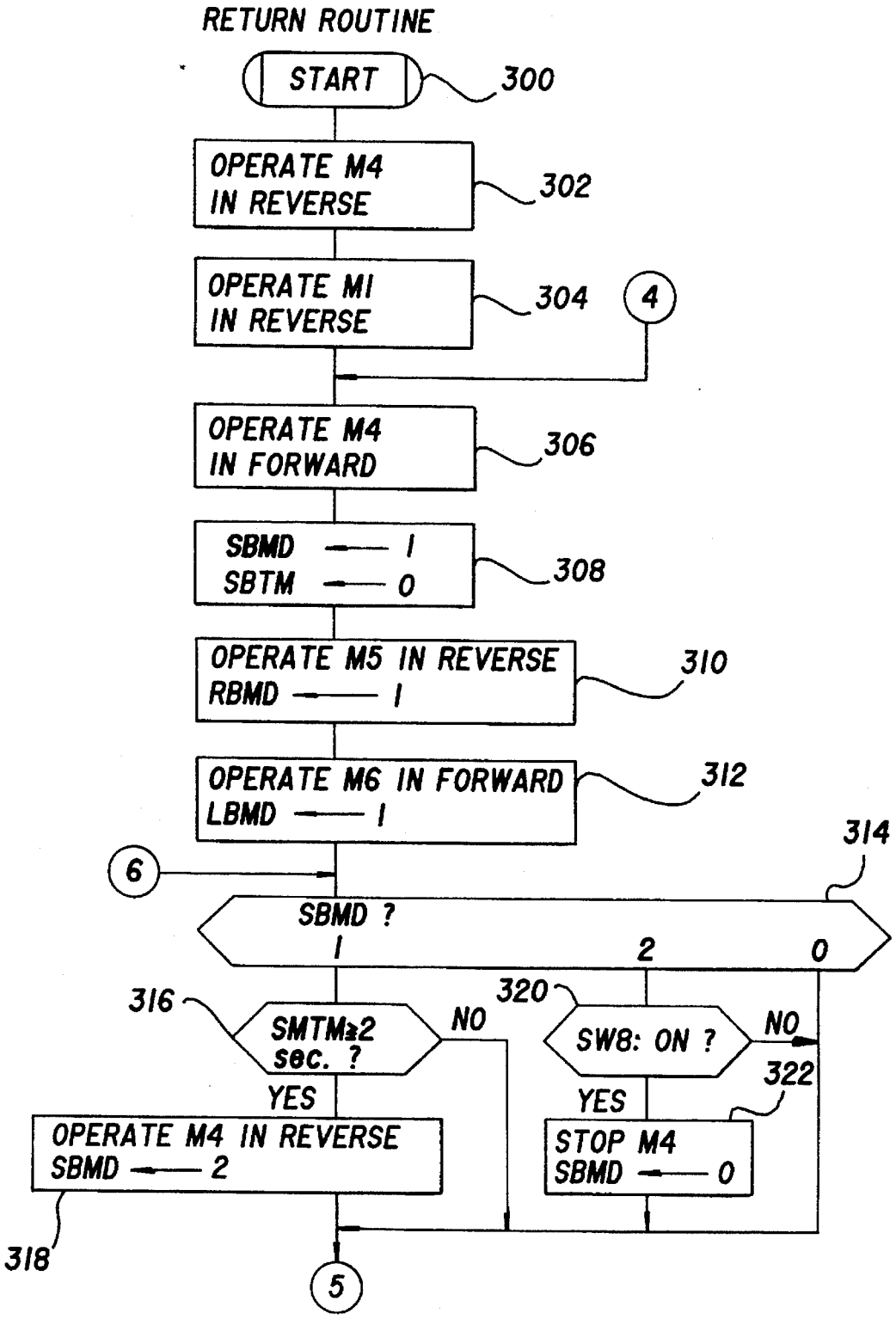
FIG. 17 is a front part of a flow chart illustrating in detail a return routine shown in FIG. 14.
Figure 18:
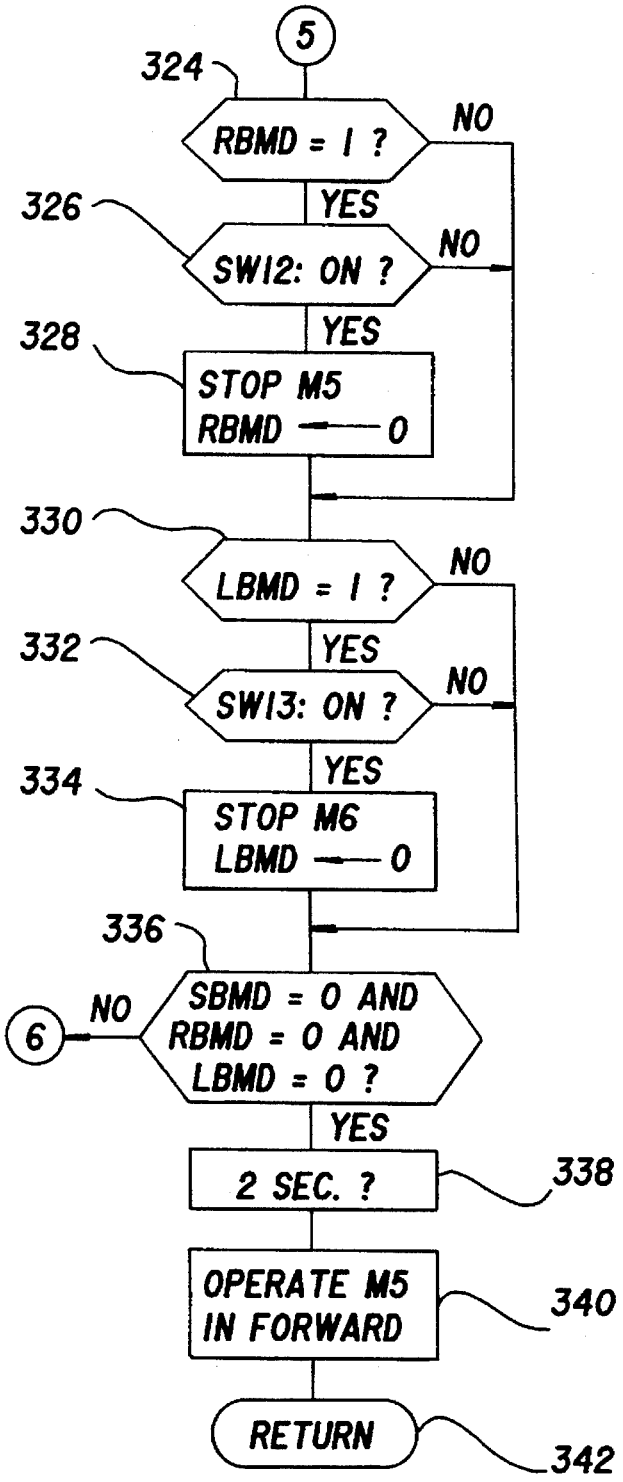
FIG. 18 is a rear part of the flow chart illustrating in detail the return routine.
Figure 19A:
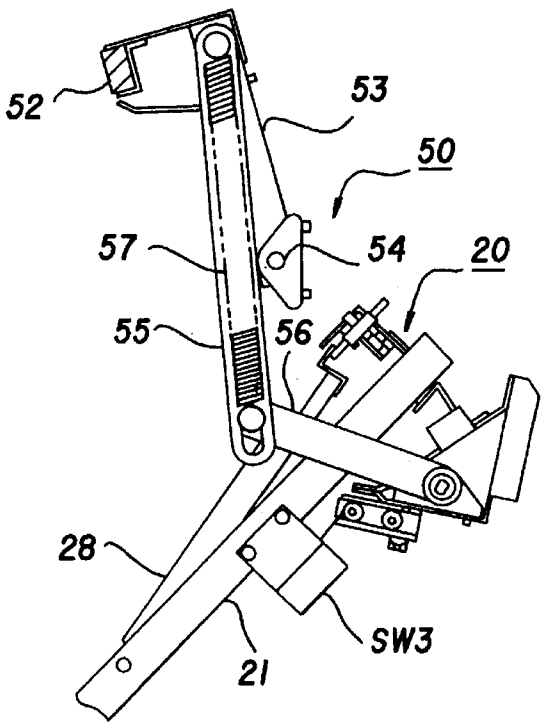
FIG. 19(A)–(C) illustrates mode of operation of a sealing mechanism.
Figure 19B:
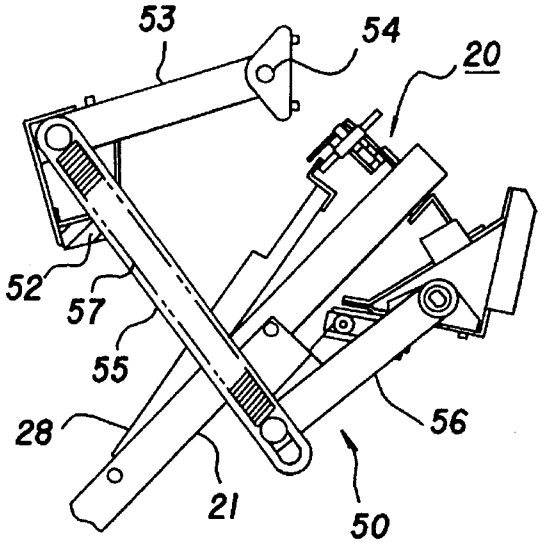
Figure 19C:
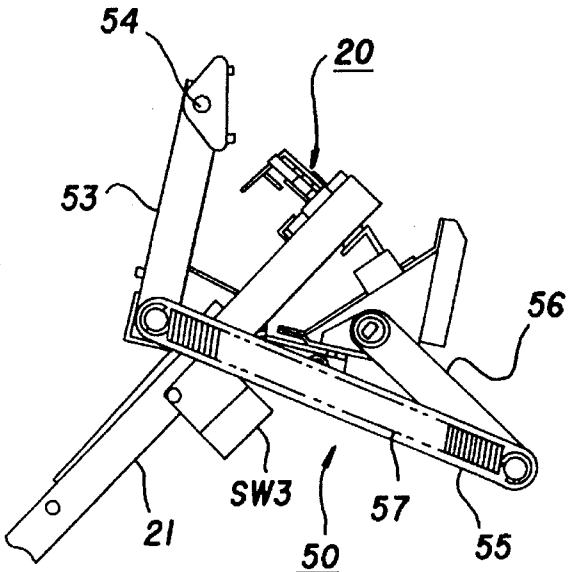

Assuming that the computer 81 initiated execution of the return routine at step 300 in FIG. 17, the electric motor M4 is rotated in a reverse direction under control of the computer 81 at step 302 until the detection switch SW8 is turned on. Thus, the drive arms 56, 56 and link members 55, 55 of sealing mechanism 50 are operated to rotate the arch-shaped support arm 53 clockwisely so that the heat seal bar 52 is retained at the upper position as shown in FIG. 19(A). At the following step 304, the electric motor M1 is rotated in a reverse direction under control of the computer 81 until the detection switch SW2 is turned on. Thus, the main arm 21 of bag feeding mechanism 20 is returned to its resting position as shown in FIG. 4. When the program proceeds to step 306, the electric motor M4 is rotated in a forward direction under control of the computer 81 until the detectin switch SW9 is turned on. In this instance, the arch-shaped support arm 53 is rotated by forward rotation of the electric motor M4 so that the heat seal bar 52 is retained at the lower position as shown in FIG. 19(C). When the program proceeds to step 308 after processing at step 302–306, the computer 81 sets a flag SBMD indicative of a control condition of electric motor M4 as "1" and sets a timer value SBTM for defining the operation time of electric motor M4 as "0". At the following step 310, the computer 81 causes the electric motor M5 to rotate in a reverse direction and sets a flag RBMD indicative of a control condition of the electric motor M5 as "1". When the program proceeds to step 312, the computer 81 causes the electric motor M6 to rotate in a forward direction and sets a flag LBMD indicative of a control condition of the electric motor M6 as "1". Subsequently, the computer 81 repeatedly executes processing at step 314 to 336 during which an interruption program (not shown) is executed at each lapse of a predetermined time to count up the timer value SBTM by "1".

Figure 20D:
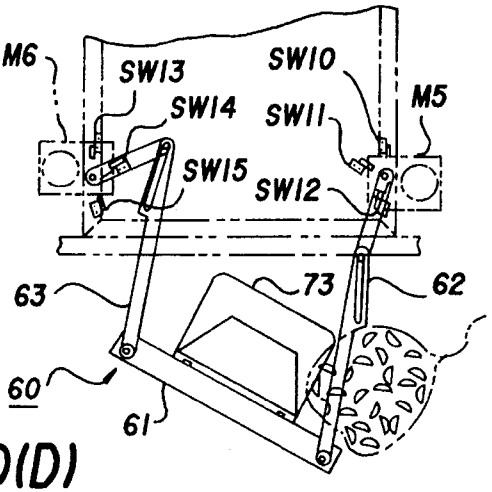

When two seconds have elapsed after initial settting of the timer value SBTM during execution of processing at step 314 to 336, the computer 81 causes the electric motor M4 to rotate in the reverse direction by processing at step 314 to 318 and changes the flag SBMD to "2". Thus, the heat seal bar 52 is moved upward and retained at the upper position to turn on the detection switch SW8. When the detection switch SW8 is turned on, the computer 81 deactivates the electric motor M4 by processing at step 314, 320 and 322 and resets the flag SBMD to "0". During execution of processing at step 314 to 336, the electric motor M5 is rotated in the reverse direction while the electric motor M6 is rotated in the forward direction. Thus, the base plate 61 is lowered at its right end and lifted at its left end by action of the links 62–65 as shown in FIG. 20(D). When the right end of base plate 61 is lowered to the lowermost position, the detection switch SW12 is turned on. When the left end of base plate 61 is lifted up to the uppermost position, the detection switch SW13 is turned on. (see FIG. 20(E). As a result, the computer 81 deactivates the electric motor M5 by processing at step 324 to 328 and changes the flag RBMD to "0". Simulatneously, the computer 81 deactivates the electric motor M6 by processing at step 330 to 334 and changes the flag LBMD to "0". When the flags SBMD, RBMD and LBMD each are changed to "0", the computer 81 determines a "Yes" answer at step 336 and causes the program to proceed to step 338.

When measured lapse of two seconds at step 338, the computer 81 causes the electric motor M5 at step 340 to rotate in the forward direction until the detection switch SW10 is turned on and terminates the execution of the retrun routine at step 342. Thus, the right end of base plate 61 is lifted by forward rotation of the electric motor M5 to the uppermost position so that the both ends of base plate 61 are retained at the uppermost position as shown in FIG. 20(B). With the execution of the return routine, the maim arm 21 is returned to its resting position, the hear seal 52 is returned to its upper position, and the both ends of base plate 61 are returned to the uppermost position. Thereafter, the computer 81 determines a "No" answer at step 116 of FIG. 14 and causes the program to proceed to step 104 for execution of the bag feeding routine.

Figure 15:
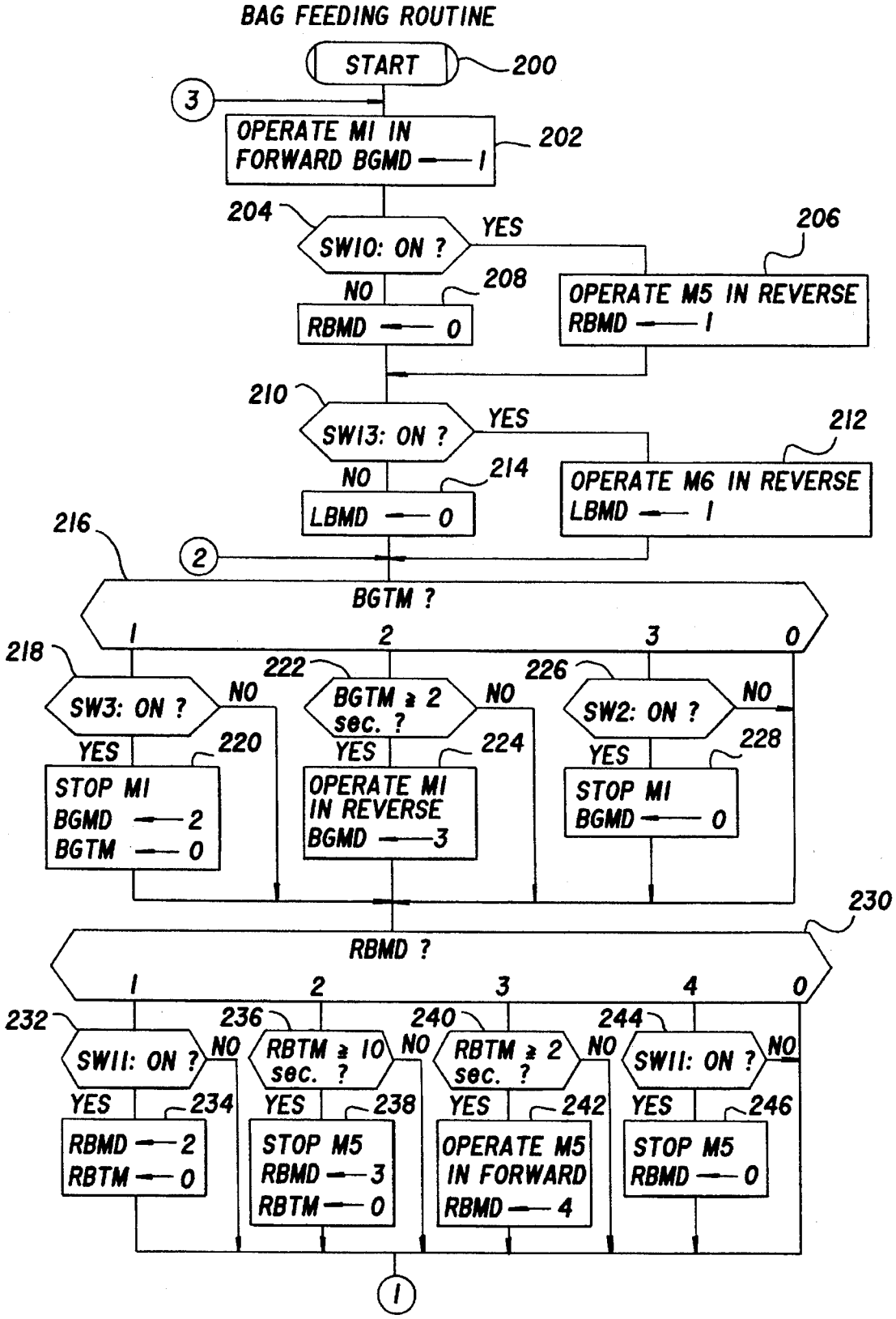
FIG. 15 is a front part of a flow chart illustrating in detail a bag feeding routine shown in FIG. 14.
Figure 16:
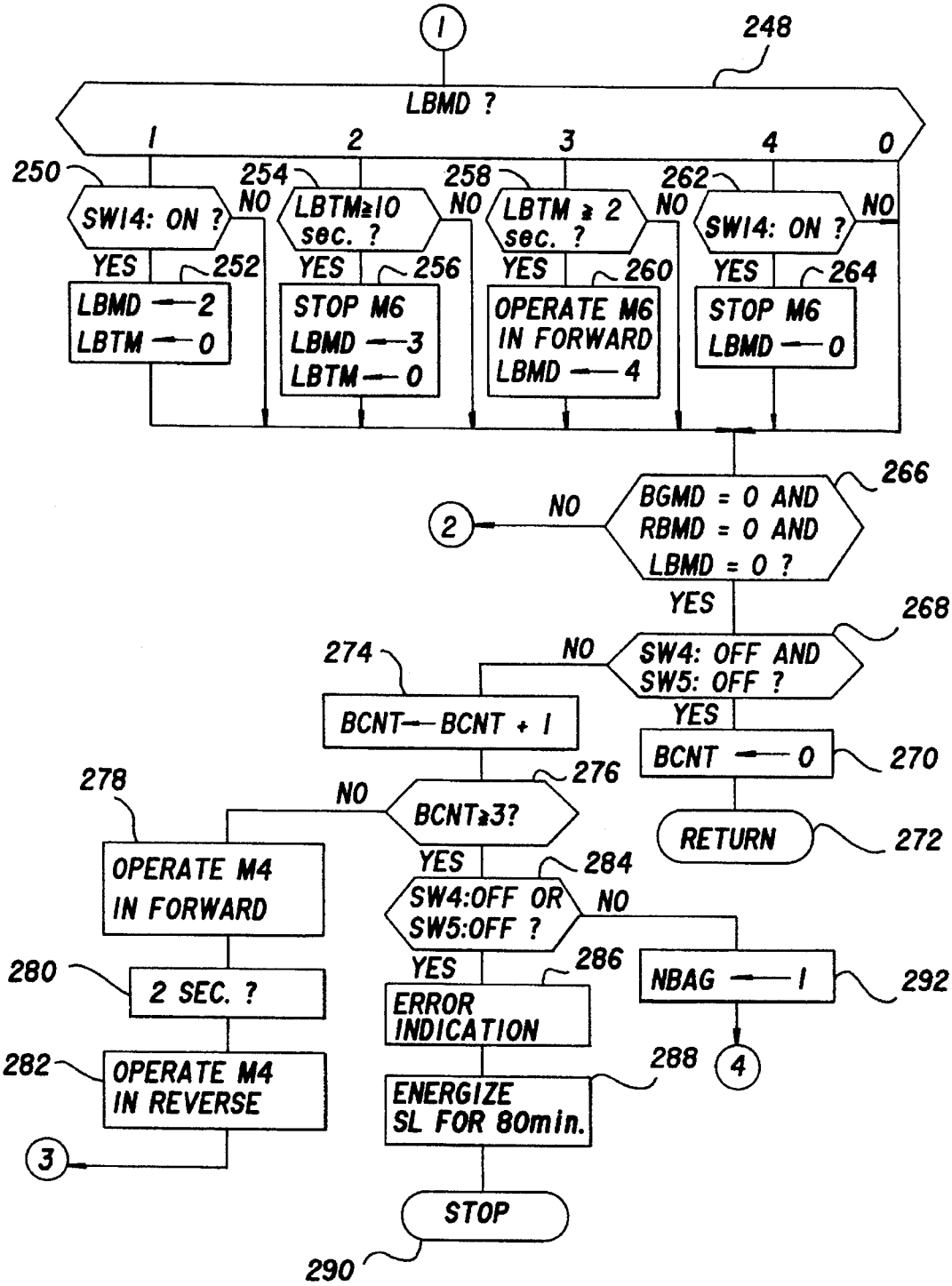
FIG. 16 is a rear part of the flow chart illustrating in detail the bag feeding routine.

The bag feeding routine is shown in detail in FIGS. 15 and 16. The computer 81 initiates execution of the bag feeding routine at step 200 and causes the electric motor M1 at step 202 to rotate in the forward direction. In this instance, the computer 81 sets the flag BGMD indicative of the control condition of electric motor M1 as "1". If the right end of of base plate 61 is placed at the uppermost position, the detection switch SW10 is turned on, and the computer 81 executes processing at step 204 and 206 to rotate the electric motor M5 in the reverse direction and to set the flag RBMD as "1". If the right end of base plate 61 is placed at the middle position, the detection switch SW 10 is tamed off, and the computer 81 executes processing at step 204 and 208 to initially set the flag RBMD as "0". If the left end of base plate 61 is placed at the uppermost position, the detection switch SW13 is turned on, and the computer 81 executes processing at step 210 and 212 to rotate the electric motor M6 in the reverse direction and to set the flag LBMD as "1". If the left end of base plate 61 is placed at the middle position, the detection switch SW13 is turned off, and the computer 81 sets the flag LBMD as "0" by processing at step 210 and 214. After processing at step 202–214, the computer 81 repeatedly executes processing at step 216–266.

During repetitive execution of the processing at step 216–266, the main arm 21 is moved by the forward rotation of electric motor M1 counterclockwisely from its resting position shown in FIG. 4. In this instance, the sub-arm 22 and release lever 28 are moved with the main arm 21, and the movement of sub-arm 22 is stopped when the plate 24 of sub-arm 22 is engaged at its front end with the foremost bag F in cassette 11. Subsequently, the main arm 21 is further moved by the forward rotation of electric motor M1 to move the vertical pins 26, 26 forwardly against the springs 27, 27. Thus, the swing levers 25, 25 are rotated by vertical pins 26, 26 so that the movable pawls **25*a*, 25*a* are engaged with the stationary pawls 24*a*, 24*a* to grasp the front portion of the foremost bag F. In such a condition, the main arm 21 is positioned in front of the sub-arm 22 to turn on the detection switch SW3, and the springs 27*a*, 27*a* act to maintain the engagement of pawls 24*a*, 24*a* and 25*a*, 25*a*** for retaining the front portion of the foremost bag F.

Figure 12:
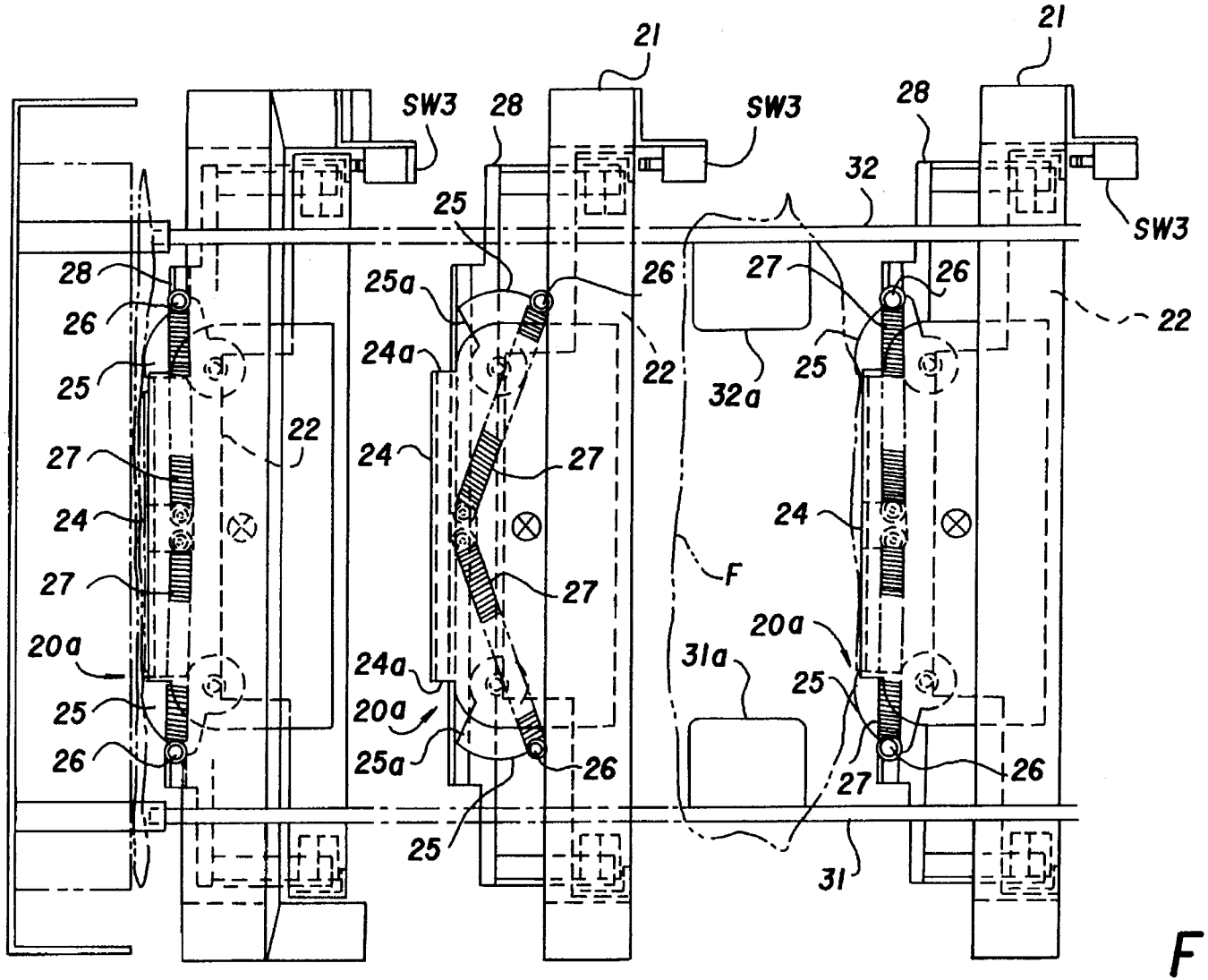
FIG. 12 is a plan view illustrating mode of operation of the bag feeding mechanism.

When the detection switch SW3 is turned on, the computer 81 stops the forward rotation of the electric motor M1 by processing at step 216–220 , changes the flag BGMD to "2" and sets the time value BGTM for defining the operation time of electric motor M1 as "0". Upon lapse of two seconds after stopping of the electric motor M1, the computer 81 causes the electric motor M1 to rotate in the reverse direction by processing at step 216, 222 and 224 and changes the flag BGMD to "3". Thus, the main arm 21 is rotated clockwisely in FIG. 4 and returned to its resting position. Simultaneously, the sub-arm 22 is rotated with the main arm 21 and returned to its resting position. When the detection switch SW2 is turned on by return movement of the main arm 21, the computer 81 stops the reverse rotation of the electric motor M1 by processing at step 216, 226 and 228 and resets the flag BGMD to "0". In this condition, the swing levers 25, 25 are being biased forwardly by action of the springs 27, 27 so that the clamping mechanism 20 acts to grasp the front portion of the foremost bag F. Thus, the bag F is moved along the support rods 31, 32 and deployed by engagement with the stoppers 31*a*, 32*a* at its attachment portion Fa as shown in FIG. 12.

When the electric motors M5 and M6 are rotated in the reverse direction by processing at step 206, 212, the both ends of base plate 61 are lowered. When the detection switches SW11 and SW14 are turned on by downward movement of the base plate 61, the computer 81 executes processing at step 230–234 and 248–252 to maintain the reverse rotation of electric motors M5, M6 for ten seconds during which the both ends of base plate 61 are slightly lowered from the middle position. Thereafter, the computer 81 executes processing at step 230, 236–242 and 248, 254–260 to stop the electric motors M5, M6 for two seconds and to rotate them in the forward direction after lapse of the two seconds. When the electric motors M5, M6 are rotated in the forward direction, the both ends of base plate 61 are lifted to the middle position. When the detection switches SW11 and SW14 are turned on by upward movement of the base plate 61, the computer 81 stops the forward rotation of electric motors M5, M6 by processing at step 230, 244, 246 and 248, 262, 264 and resets the flags RBMD, LBMD to "0", respectively. From the above description, it will be understood that when the base plate 61 is lowered to the middle position from the uppermost position, the base plate 61 is once lowered below the middle position and lifted to the middle position. This is effective to accurately place the base plate 61 at the middle position without any influence of gravity. When the flags BGMD, RBMD, LBMD each are reset to "0", the computer 81 determines a "Yes" answer at step 266 and causes the program to proceed to step 268.

At step 268, the computer 81 determines whether both the detection switches SW4, SW5 are turned off or not. When the foremost bag F is correctly grasped by the clamping mechanism 20*a* at its two positions so that the attachment portion Fa of the bag F is engaged with the stoppers 31*a*, 32*a*, the support rods 31, 32 are rotated counterclockwisely by rotation of the sub-arm 22 against the springs 33, 34. Thus, the detection switches SW4, SW5 are turned off by rotation of the light blocking plates 35, 36. In this instance, the computer 81 determines a "Yes" answer at step 268, sets a count value BCNT indicative of the number of grasping times of the bag F at step 270 and terminates the execution of the bag feeding routine at step 272.

Subsequently, the computer 61 starts at step 106 to execute an ice supply-weighing routine. By processing of the ice supply-weighing routine, the electric motor M2 or M3 is operated to drive the right or left auger 43*a* or 43*b* in the forward direction. Thus, the ice cubes are delivered upwardly from the right or left storage tank 41*a* or 41*b* through the right or left delivery chute 42*a* or 42*b* and supplied into the bag F supported by the support rods 31 and 32. If in this instance each amount of ice cubes stored in the storage tanks 41, 41*b* is more than for one bag, both the detection switches SW6L, SW7L are being turned on, and the electric motors M2, M3 are alternately operated in the forward direction by processing at step 104–116 to supply ice cubes into the supported bag F alternately from the storage tanks 41*a* or 41*b*. If an amount of ice cubes in either one of the storage tanks 41*a*, 41*b* is more than for one bag, either one of the detections switches SW6L, SW7L is turned on, and either one of the electric motors M2 and M3 is operated in the forward direction. In such operation for supply of the ice cubes, the electric motors MS, M6 each are operated in the forward direction to lift the base plate 61 up to the uppermost position so that the entire weight of supplied ice cubes is received by the base plate 61 without supported by the support rods 31, 32. When the supported bag F is supplied with a predetermined amount of ice cubes after received by the base plate 61 as shown in FIG. 20(B), the detection switch SW16 is turned on, and the computer 81 stops the forward rotation of the electric motor M2 or M3 to cease the supply of ice cubes from the right or left storage tank 41*a* or 41*b*.

Subsequently, the computer 81 executes processing at step 108–112 for heat sealing the upper opening of the bag F supplied with the ice cubes. At step 108, the electric motor M4 is operated in the forward direction under control of the computer 81 to rotate the heat seal bar 52 counterclockwisely in FIG. 4 for engagement with the rear upper portion of the bag F supported by the support rods 31 and 32. Thus, the rear upper portion of the bag F is moved by the counterclockwise rotation of the support rods 31, 32 toward the heater block 51. In this instance, the front portion of the bag F is being grasped by the movable pawls 25*a*, 25*a* and the stationary pawls 24*a*, 24*a* so that the bag F is clamped by the heater block 51 and heat seal bar 52 at its upper opening portion. When engaged with the heater block 51, the heat seal bar 52 moves the release lever 28 of bag feeding mechanism 20 clockwisely in FIG. 4, and the vertical pins 26, 26 are moved by engagement with the release lever 28 rightwardly in FIG. 12. As a result, the swing levers 25, 25 are rotated to release the bag F from the movable pawls 25*a*, 25*a*. In such a condition, the main arm 21, sub-arm 22, swing levers 25, 25 are retained at their released positions under the biasing force of springs 27, 27, and the detection switch SW9 is turned on to stop the forward rotation of the electric motor M4 under control of the computer 81.

At step 110, the heater element 51*a* of heater block 51 is energized from 0.6 seconds under control of the computer 81 to heat seal the upper opening portion of the bag F clamped by the heater block 51 and heat seal bar 52. At the following step 112, the electric motor M4 is operated in the reverse direction under control of the computer 81 to move the heat seal bar 52 and support arm 53 upwardly and return them to their resting positions shown in FIG. 4. When the driving arm 56 is returned to its resting position, the detection switch SW8 is turned on, and the electric motor M4 is deactivated under control of the computer 81. In such a condition, the sealed bag F is placed on the weighing plate 72 mounted on the base plate 61.

Figure 20E:
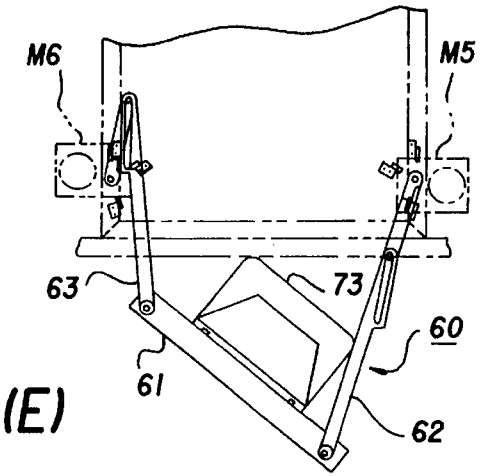

Subsequently, the computer 81 executes at step 114 a bag dropping routine for dropping the bagged ice cubes into the ice storage bin C. By processing of the bag dropping routine, the electric motors M5, M6 each are operated in the reverse direction under control of the computer 81 to lower the base plate 61 by action of the link members 62–65. In this instance, the base plate 61 is placed at the uppermost position as shown in FIG. 20(B) and is moved down to the lower position shown in FIG. 20(C). When the detection switches SW12, SW15 are turned on by downward movement of the base plate 61, the computer 81 stops the reverse rotation of the electric motors M5, M6. Thereafter, the electric motor M6 or M5 is operated in the forward direction under control of the computer 81 to lift the left or right end of the base plate 61. Thus, the base plate 61 is tilted to drop the bagged ice cubes into the ice storage bin C as shown in FIG. 20(D). When the left or right end of the base plate 61 is lifted up to the uppermost position as shown in FIG. 20(E), the detection switch SW13 or SW10 is turned on, and the computer 81 stops the forward rotation of electric motor M6 or M5. Subsequently, the computer 81 cooperates with the detection switches SW11, SW14 to operate the electric motors M5, M6 thereby to move the both ends of base plate 61 to the middle position.

After processing at step 114, the computer 81 determines whether a flag NBAG indicative of lack of the bag F is "1" or not. Since the flag NBAG is initially set as "0", the computer 81 determines a "No" answer at step 116 and returns the program to step 104 to repeat processing at step 104–116. During repetitive processing at step 104–116, the computer 81 controls the sequence operation comprised of the steps of operating the bag feeding mechanism 20 for feeding a foremost bag to the predetermined position, operating the ice delivery mechanism 40A or 40B for supplying ice cubes into the bag until a predetermined amount of ice cubes is measured by the weighing mechanism 70, operating the sealing mechanism 50 for heat sealing the upper opening portion of the bag and operating the bag dropping mechanism. Thus, the predetermined amount of ice cubes is successively bagged and accumulated in the ice storage bin C.

Assuming that the clamping mechanism 20*a* does not act to correctly grasp the front portion of the bag at its two positions, either one of the stoppers 31*a*, 32*a* is not stretched by the main arm 21 even when the main arm 21 is returned to its resting position. In this instance, either one of the support rods 31, 32 may not be rotated counterclockwisely against the spring 33 or 34, and either one of the light blocking plates 35, 36 is maintined in its on-position. Thus, the computer 81 determines a "No" answer at step 268 of FIG.16, adds "1" to the count value BCNT at step 274 and determines at step 276 whether the count value BCNT is more than "3" or not. If the count value BCNT is less than "3", the computer 81 determines a "No" answer at step 276 and causes the program to proceed to step 278–282.

At step 278, the electric motor M4 is operated in the forward direction under control of the computer 81 until the detection switch SW9 is turned on. Thus, the support arm 53 is moved by the forward rotation of the electric motor M4 clockwisely to move down the heat seal bar 52 to the lower position. As a result, the bag F is released by the downward movement of heat seal bar 52 from the clamping mechanism 20*a* and drops on the base plate 61 or into the ice storage bin C. Subsequently, the computer 81 stops the electric motor M4 for two seconds at step 280 and operates the electric motor M4 in the reverse direction at step 282 until the detection switch SW8 is turned on. The reverse rotation of electric motor M4 causes the support arm 53 to rotate clockwisely in FIG. 19 thereby to move the heat seal bar 52 up to its resting position. After processing at step 278–282, the computer 81 causes the program to proceed to step 202 for execution of the bag feeding routine at step 202–266. As described above, if the clamping mechanism 20*a* failed to grasp a foremost bag of the stacked bags in operation, the bag feeding mechanism 20 is automatically operated under control of the computer 81 after the bag has been removed. Accordingly, the clamping mechanism 20*a* is operated again to grasp a foremost bag of the stacked bags without any trouble in operation.

When the foremost bag F of the stacked bags has been correctly grasped by the clamping mechanism 20*a*, the computer 81 determines a "Yes" answer at step 268 and resets the count value BCNT to "0" at step 270 to terminate the execution of the bag feeding routine at step 272. When the clamping mechanism 20*a* failed again to grasp the foremost bag F, the computer 81 determines a "No" answer at step 268 and causes the program to proceed to step 274–276. When the clamping mechanism 20*a* failed three times to grasp the foremost bag F, the count value BCNT becomes "3". In this instance, the computer 81 determines a "Yes" answer at step 276 and causes the program to proceed to step 284. At step 284, the computer 81 determines whether either one of the detections switches SW4, SW5 is turned off or not.

In case the clamping mechanism 20*a* grasped only one position of the foremost bag but failed to grasp another position of the foremost bag, either one of the detection switches SW4, SW5 is turned off. In this instance, the computer 81 determines a "Yes" answer at step 284 and causes the program to proceed to step 286–288. At step 286, the computer 81 produces a signal data indicative of an error in grasping the foremost bag and applies it to the indication device 83. Thus, the indication device 83 indicates an error code thereon to inform the user of an error in operation of the bag feeding mechanism 20. At step 288, the solenoids SLa. SLb are energized for eighty (80) minutes to supply water into the watering pipes 45*a*, 45*b* from the external source of water through the water valves 46*a*, 46*b*. Thus, the watering pipes 45*a*, 45*b* sprinkle the water over the ice cubes remained in the storage tanks 41*a*, 41*b* to dissolve them. Accordingly, even if the ice cubes are remained in the storage tanks for a long time without being bagged in the occurrence of abnormality in operation of the bag feeding mechanism 20, adherence of the ice cubes in the storage tanks 41*a*, 41*b* can be eliminated to avoid a trouble in operation of the ice delivery mechanisms 40A, 40B. After processing at step 286 and 288, the computer 81 terminates the execution of the program at step 290 to cease the control of the sequence operation of the respective mechanisms. Consequently, dispersion of the ice cubes in the bagging apparatus B and the ice storage bin C can be avoided.

When the clamping mechanism 20*a* is operated in a condition where there is not any bag in the bag storage mechanism 20, the detection switches SW4, SW5 are maintained in their on-positions. In this instance, the computer 81 determines a "No" answer at step 284, sets the flag NBAG as "1" at step 292 and causes the program to proceed to step 306 for execution of the return routine. Thus, the computer 81 returns the heat seal bar 52 to its resting position by processing at step 306–342 and returns the both ends of the base plate 61 to the uppermost position as described above. After execution of the return routine, the computer 81 causes the program to proceed to step 116 of FIG. 14. Since the flag NBAG is previously set as "1", the computer 81 determines a "Yes" answer at step 116 and causes the program to proceed to step 118 and 120.

At step 118, the computer 81 produces a signal data indicative of lack of the bag in the bag storage mechanism 10 and applies it to the indication device 83. When applied with the signal data, the indication device 83 is activated to indicate a numerical code indicative of lack of the bag thereon for informing the user of necessity for supplying stacked bags to the bag storage mechanism 10. At step 120, the solenoids SLa, SLb are energized for eighty minutes under control of the computer 81 to supply water into the watering pipes 45*a*, 45*b* as described above. Thus, the watering pipes 45*a*, 45*b* sprinkle the water over the ice cubes remained in the storage tanks 41*a*, 41*b* to melt them. Accordingly, even if the ice cubes are remained in the storage tanks for a long time without being bagged due to lack of the bag, adherence of the ice cubes in the storage tanks 41*a*, 41*b* can be eliminated to avoid a trouble in operation of the ice delivery mechanisms 40A, 40B. After processing at step 118 and 120, the computer 81 terminates the execution of the program at step 122 to cease the control of the sequence operation of the respective mechanisms.

Consequently, dispersion of the ice cubes in the bagging apparatus B and the ice storage bin C can be avoided.

Although in the above embodiment the bagging apparatus B has been adapted for bagging ice cubes, the bagging apparatus may be adapted for bagging cakes, candies or other articles. In such a case, the articles are stored in the storage tanks 41*a*, 41*b*, and the watering mechanism is eliminated. Although in the above embodiment the indication device 83 has been designed to indicate numerical codes, the indication device 83 may be provided with two lamps respectively for indicating lack of the bag and an error in operation of the bag feeding mechanism. Although in the above embodiment each operation time of the mechanisms has been defined by numerical values, the operation time of the respective mechanisms may be changed in accordance with the capacity and performance of the component parts.

What is claimed is:

1. An automatic bagging apparatus for successively bagging a predetermined amount of articles, comprising a bag storage mechanism arranged to store a number of stacked bags the upper openings of which are positioned upwardly, a bag feeding-support mechanism arranged to feed a foremost bag of the stacked bags to a predetermined position and to support the foremost bag for deploying the upper opening of the bag, a delivery mechanism arranged within a storage tank to deliver articles therefrom into the deployed bag, a weighing mechanism arranged to measure an amount of articles supplied into the deployed bag, a sealing mechanism arranged to seal the upper opening of the bag supplied with a predetermined amount of the articles, and an electric control apparatus for repeatedly controlling a sequence operation comprised of the steps of operating the bag feeding-support mechanism for feeding the foremost bag to the predetermined position, operating the delivery mechanism for supplying the articles from the storage tank into the deployed bag until a predetermined amount of the articles is measured by the weighing mechanism and operating the sealing mechanism for sealing the upper opening of the bag, wherein the bag feeding-support mechanism comprises a clamping mechanism for grasping the foremost bag at two laterally spaced positions thereof, a movable mechanism cooperable with the clamping mechanism for feeding the foremost bag grasped by the clamping mechanism, a pair of support rods for supporting the foremost bag fed by the movable mechanism and a pair of detection means for detecting the fact that the foremost bag is being correctly grasped by the clamping mechanism at the two laterally spaced positions, and wherein the electric control apparatus comprises an indication device, first control means for controlling the indication device to indicate an error in operation of the bag feeding-support mechanism when one of the detection means has detected the fact that the bag is being grasped by the clamping mechanism at one position of said two laterally spaced positions while the other detection means has detected the fact that the bag could not be grasped by the clamping mechanism at another position of said two laterally spaced positions, and second control means for activating the indication device to indicate lack of the bag when both the detection means have detected the fact that the bag could not be correctly grasped by the clamping mechanism at the two laterally spaced positions.

2. An automatic bagging apparatus for successively bagging a predetermined amount of articles, comprising a bag storage mechanism arranged to store a number of stacked bags the upper openings of which are positioned upwardly, a bag feeding-support mechanism arranged to feed a foremost bag of the stacked bags to a predetermined position and to support the foremost bag for deploying the upper opening of the bag, a delivery mechanism arranged within a storage tank to deliver articles therefrom into the deployed bag, a weighing mechanism arranged to measure an amount of articles supplied into the deployed bag, a sealing mechanism arranged to seal the upper opening of the bag supplied with a predetermined amount of the articles, and an electric control apparatus for repeatedly controlling a sequence operation comprised of the steps of operating the bag feeding-support mechanism for feeding the foremost bag to the predetermined position, operating the delivery mechanism for supplying the articles from the storage tank into the deployed bag until a predetermined amount of the articles is measured by the weighing mechansim and operating the sealing mechanism for sealing the upper opening of the bag, wherein the bag feeding-support mechanism is provided with detection means for detecting the fact that the bag has been correctly fed to the predetermined position, and wherein the electric control apparatus comprises means for repeatedly operating the bag feeding-support mechanism when it has been detected by the detection means that the bag could not be correctly fed to the predetermined position and means for stopping the sequence operation of the foregoing mechanisms when it has been detected by the detection means that the bag could not be correctly fed to the predetermined position even when the bag feeding-support mechanism was repeatedly operated more than a predetermined number of times.

3. An automatic bagging apparatus as set forth in claim 2, wherein the bag feeding-support mechanism is provided with a release mechanism for releasing the bag from the bag feeding-support mechanism, and wherein the electric control apparatus comprises means for controlling the release mechanism to release the bag from the bag feeding-support mechanism when it has been detected by the detection means that the bag could not be correctly fed to the predetermined position.

4. An automatic bagging apparatus for successively bagging a predetermined amount of ice cubes, comprising a bag storage mechanism arranged to store a number of stacked bags the upper openings of which are positioned upwardly, a bag feeding-support mechanism arranged to feed a foremost bag of the stacked bags to a predetermined position and to support the foremost bag for deploying the upper opening of the bag, a storage tank arranged to store an amount of ice cubes, a delivery mechanism arranged within the storage tank to deliver the ice cubes therefrom into the deployed bag, a weighing mechanism arranged to measure an amount of the ice cubes supplied into the deployed bag, a sealing mechanism arranged to seal the upper opening of the bag supplied with a predetermined amount of the ice cubes, and an electric control apparatus for repeatedly controlling a sequence operation comprised of the steps of operating the bag feeding-support mechanism for feeding the foremost bag to the predetermined position, operating the delivery mechanism for supplying the ice cubes from the storage tank into the deployed bag until a predetermined amount of the ice cubes is measured by the weighing mechanism and operating the sealing mechanism for sealing the upper opening of the bag, wherein the bag feeding-support mechanism is provided with detection means for detecting the fact that the foremost bag has been correctly fed to the predetermined position, wherein a watering pipe is arranged above the storage tank, and wherein the electric control apparatus comprises means for stopping the sequence operation of the foregoing mechanisms and supplying water into the watering pipe when it has been detected by the detection means that the bag could not be correctly fed to the predetermined position.

* * * * *